US009078530B2

(12) United States Patent
Ingram et al.

(10) Patent No.: US 9,078,530 B2
(45) Date of Patent: Jul. 14, 2015

(54) INFANT PLAYPEN CAPABLE OF RECEIVING THE INSTALLATION OF MULTIPLE REMOVABLE ACCESSORIES

(71) Applicant: Wonderland Nurserygoods Company Limited, Kwai Chung, N.T. (HK)

(72) Inventors: Jerry S. Ingram, Denver, PA (US); Curtis M. Hartenstine, Birdsboro, PA (US); Daniel A. Sack, Pottstown, PA (US); Ryan N. Miller, Lancaster, PA (US); William B. Bellows, Wyomissing, PA (US); Nathanael Saint, Morgantown, PA (US); Andrew J. Horst, West Lawn, PA (US); Benjamin A. Stack, Broomall, PA (US)

(73) Assignee: Wonderland Nurserygoods Company Limited (HK)

( * ) Notice: Subject to any disclaimer, the term of this patent is extended or adjusted under 35 U.S.C. 154(b) by 0 days.

(21) Appl. No.: 14/457,191

(22) Filed: Aug. 12, 2014

(65) Prior Publication Data

US 2015/0047122 A1 Feb. 19, 2015

Related U.S. Application Data

(60) Provisional application No. 61/959,047, filed on Aug. 13, 2013.

(51) Int. Cl.
*A47D 13/06* (2006.01)

(52) U.S. Cl.
CPC ..... *A47D 13/063* (2013.01); *A47D 13/06* (2013.01); *A47D 13/061* (2013.01)

(58) Field of Classification Search
CPC .... A47D 13/06; A47D 13/061; A47D 13/063
USPC ..... 5/93.1, 93.2, 99.1
See application file for complete search history.

(56) References Cited

U.S. PATENT DOCUMENTS

| | | | | |
|---|---|---|---|---|
| 2,688,997 | A * | 9/1954 | Miller | 297/129 |
| 5,745,954 | A | 5/1998 | Shogan et al. | |
| 6,173,462 | B1 * | 1/2001 | Huang et al. | 5/655 |
| 6,192,535 | B1 * | 2/2001 | Warner et al. | 5/93.1 |
| 7,458,114 | B2 * | 12/2008 | Troutman | 5/93.1 |
| 8,316,481 | B2 | 11/2012 | Arnold, IV et al. | |
| 8,544,125 | B2 | 10/2013 | Greger et al. | |

(Continued)

FOREIGN PATENT DOCUMENTS

EP 2671472 A1 11/2013

*Primary Examiner* — Michael Trettel
(74) *Attorney, Agent, or Firm* — David I. Roche; Baker & McKenzie LLP

(57) ABSTRACT

An infant playpen includes a plurality of upright legs, and a first and a second upper side rail assembly supported by the upright legs. Each of the first and a second upper side rail assembly includes at least one elongated segment having an outer surface, and a plurality of positioning regions are defined on the outer surfaces of the elongated segments, each of the positioning regions being configured to locate a connection of a removable accessory on the infant playpen. An infant care system is also disclosed, which includes the infant playpen and a removable accessory installed thereon. One selected positioning region of the first upper side rail assembly can be received in a housing of the removable accessory, and a locking part of the removable accessory is displaced to a locked position that retains the selected positioning region in the housing.

45 Claims, 21 Drawing Sheets

(56) References Cited

U.S. PATENT DOCUMENTS

2006/0253979 A1* 11/2006 Chen ..... 5/93.1
2012/0037868 A1* 2/2012 Hartenstine et al. ..... 256/25
2012/0204347 A1 8/2012 Li
2012/0266380 A1 10/2012 Conrad et al.
2013/0125304 A1 5/2013 DeHart et al.

* cited by examiner

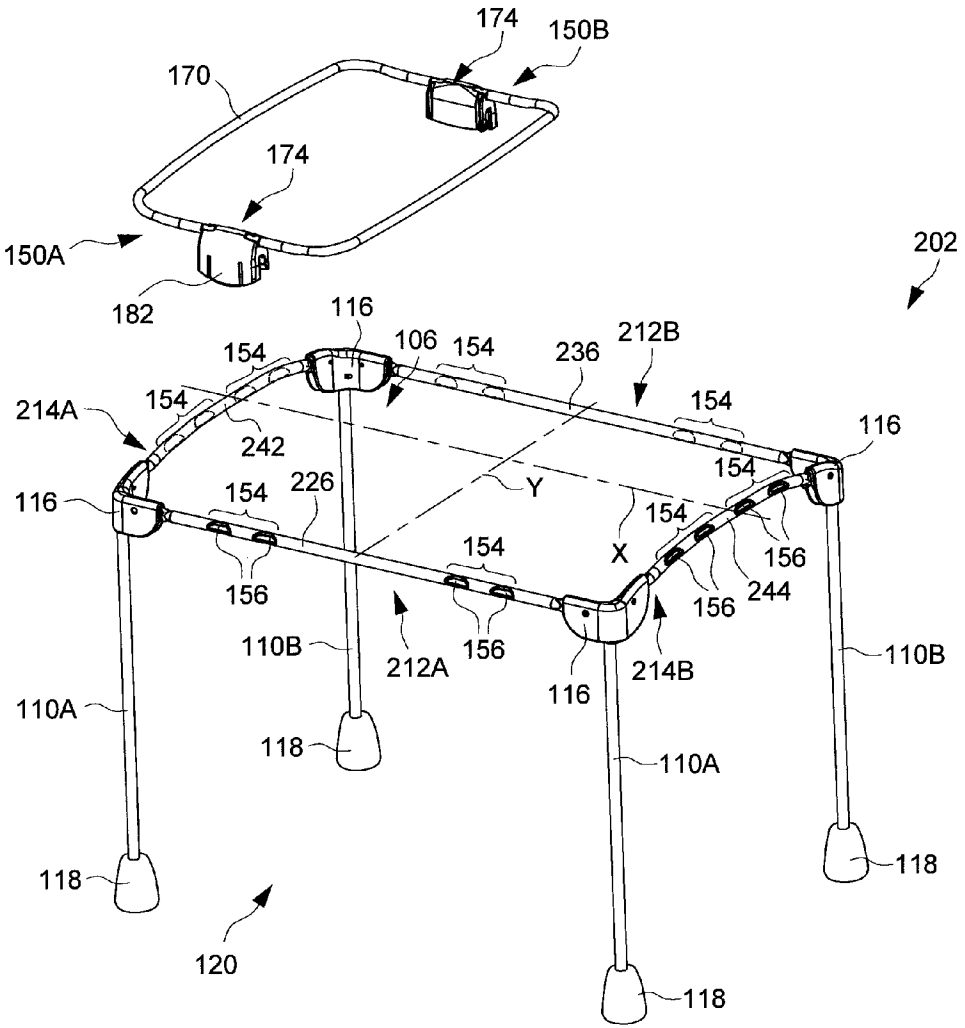
202
150B
174
170
174
182
150A
116
106
116
212B
236
154
154
154

INFANT PLAYPEN CAPABLE OF RECEIVING THE INSTALLATION OF MULTIPLE REMOVABLE ACCESSORIES

CROSS-REFERENCE TO RELATED APPLICATION(S)

This application claims priority to U.S. Provisional Patent Application No. 61/959,047 filed on Aug. 13, 2013, which is incorporated herein by reference.

BACKGROUND

1. Field of the Invention

The present invention relates to an infant playpen capable of receiving the installation of multiple accessories in different configurations.

2. Description of the Related Art

An infant playpen may be typically used in combination with diverse accessories that can facilitate care for the child, such as bassinets and changing stations. Because the infant playpen is almost entirely covered with a fabric material, the connections of the accessories with the frame of the infant playpen may be difficult to achieve. For example, the playpen frame may need separate attachment features for fastening a bassinet and a changing station on the playpen frame. Moreover, most of the conventional attachment features limit the installation of the accessory to one specific orientation, and have a more complex construction that requires partial disassembly when the accessory is removed from the playpen frame.

Therefore, there is a need for an improved design that can provide an infant playpen that is more convenient in use, and can address at least the foregoing issues.

SUMMARY

The present application describes an infant playpen having a plurality of positioning regions capable of engaging with one or more removable accessory in different configurations. In one embodiment, the infant playpen includes a plurality of upright legs, and a first and a second upper side rail assembly supported by the upright legs, wherein each of the first and a second upper side rail assembly includes at least one elongated segment having an outer surface, and a plurality of positioning regions are defined on the outer surfaces of the elongated segments, each of the positioning regions being configured to locate a connection of a removable accessory on the infant playpen.

The application also describes an infant care system including an infant playpen, and a removable accessory installed on the infant playpen. The infant playpen includes a plurality of upright legs, and a first and a second upper side rail assembly supported by the upright legs, wherein each of the first and a second upper side rail assembly includes at least one elongated segment having an outer surface, and a plurality of positioning regions are defined on the outer surfaces of the elongated segments. The removable accessory includes a housing having a saddle portion and a coupling portion, and a locking part pivotally connected with the housing adjacent to the saddle portion. One selected positioning region on the first upper side rail assembly is received in the saddle portion, the coupling portion engages with the selected positioning region to prevent displacement of the housing along the first upper side rail assembly, and the locking part is pivoted to a locked position that retains the selected positioning region in the saddle portion.

Advantages of the structures described herein includes the ability to provide an infant care system that can standardize the connection between an infant playpen and removable accessories. Therefore, all removable accessories can be installed on the infant playpen using the same connection positions and connection mechanism.

BRIEF DESCRIPTION OF THE DRAWINGS

FIG. 23 is a schematic view illustrating a playpen frame not collapsible and provided with a plurality of positioning regions for attachment of a removable accessory.

DETAILED DESCRIPTION OF THE EMBODIMENTS

Figure 1:
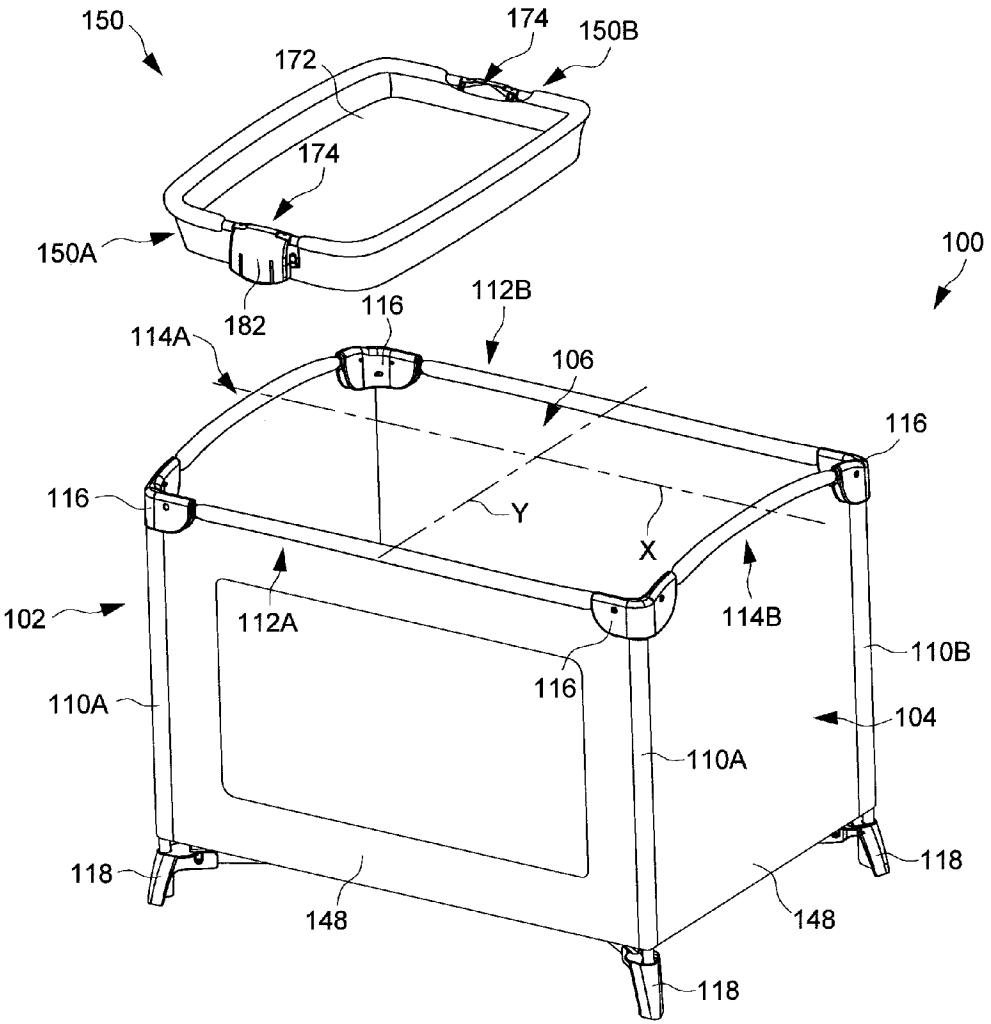
FIG. 1 is a perspective view illustrating one embodiment of an infant playpen capable of receiving a removable accessory.
Figure 2:
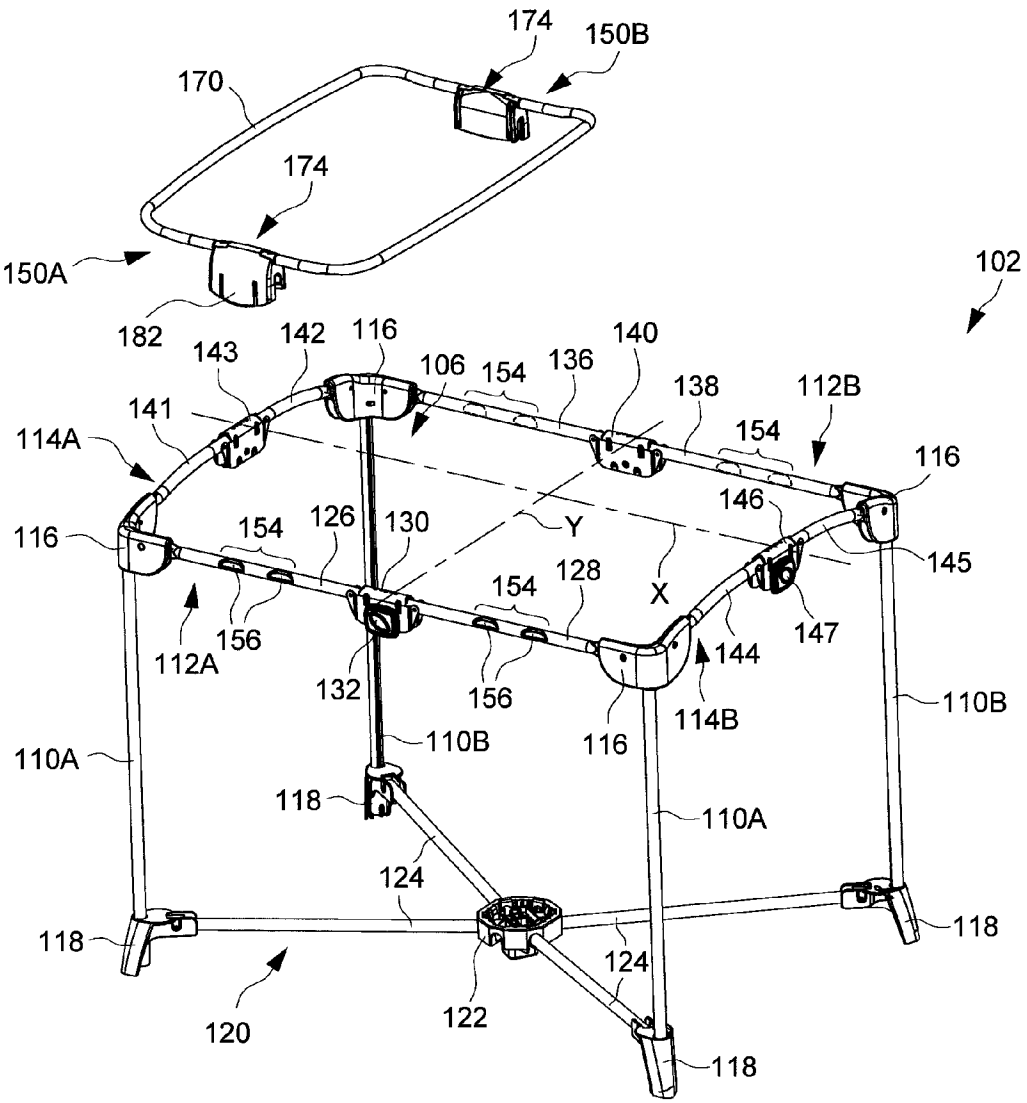
FIG. 2 is a schematic view illustrating a frame structure of the infant playpen shown in FIG. 1.

FIG. 1 is a perspective view illustrating one embodiment of an infant playpen 100, and FIG. 2 is a schematic view illustrating a rigid frame structure of the infant playpen 100. The infant playpen 100 can include a playpen frame 102 formed by the assembly of multiple tube segments, and an enclosure 104 connected with the playpen frame 102 and surrounding an interior 106 of the infant playpen 100. The playpen frame 102 can include a plurality of upright legs 110A and 110B, two upper side rail assemblies 112A and 112B opposite to each other and extending substantially parallel to each other along a first direction, and two other upper side rail assemblies 114A and 114B opposite to each other and extending substantially parallel to each other along a second direction perpendicular to the first direction. The upright legs 110A and 110B can provide support for the upper side rail assemblies 112A, 112B, 114A and 114B. The upper side rail assemblies 114A and 114B can be respectively connected with the upper side rail assemblies 112A and 112B via a plurality of corner joints 116.

Each of the upright legs 110A and 110B can be formed by an upright tubular segment that has a lower end affixed with a foot member 118, and an upper end affixed with one corner joint 116. The foot members 118 can also be pivotally connected with distal ends of a linkage assembly 120 (better shown in FIG. 2) having a cross shape. The linkage assembly 120 can include a central pivot joint 122, and four tubes 124 arranged along two diagonal directions connecting at the central pivot joint 122. The linkage assembly 120 can provide support at the bottom of the infant playpen 100.

The upper side rail assembly 112A is connected with the two upright legs 110A. The upper side rail assembly 112A can include two elongated tubular segments 126 and 128 that are respectively connected pivotally with a joint 130 at a central location of the upper side rail assembly 112A. The joint 130 can include an internal latch operable to lock the two segments 126 and 128 in an unfolded state. The joint 130 can also include a release button 132 operable to unlock the internal latch for allowing folding of the two segments 126 and 128. The distal ends of the two tubular segments 126 and 128 distant from the joint 130 can be respectively connected with two corner joints 116 of the two upright legs 110A.

The upper side rail assembly 112B is connected with the two upright legs 110B at a side opposing the upper side rail assembly 112A. Like the upper side rail assembly 112A, the upper side rail assembly 112A can include two elongated tubular segments 136 and 138 that are respectively connected pivotally with a joint 140 at a central location of the upper side rail assembly 112B. The joint 140 can include an internal latch operable to lock the two segments 136 and 138 in an unfolded state. Like the joint 130, the joint 140 can further include a release button (not shown) operable to unlock the internal latch for allowing folding of the two segments 136 and 138. The distal ends of the two tubular segments 136 and 138 distant from the joint 140 can be respectively connected with two corner joints 116 of the two upright legs 110B.

The upper side rail assemblies 114A can be respectively connected with two neighboring upright legs 110A and 110B, and can include two elongated tubular segments 141 and 142 that are respectively connected pivotally with a joint 143 at a central location of the upper side rail assembly 114A. Likewise, the upper side rail assemblies 114B can be respectively connected with the two other neighboring upright legs 110A and 110B, and can include two elongated tubular segments 144 and 145 that are respectively connected pivotally with a joint 146 at a central location of the upper side rail assembly 114B. One or two of the joints 143 and 146 can include an internal latch operable to lock the two associated segments in an unfolded state, and a release button 147 operable to unlock the internal latch for allowing folding of the two segments.

The enclosure 104 can be formed by a cloth material made of soft goods. The enclosure 104 can have a plurality of corners assembled adjacent to the upright legs 110A and 110B, and can define a plurality of sidewall panels 148 that are stretched between the upright legs 110A and 110B to surround the interior space 106 of the infant playpen 100. Moreover, upper ends of the sidewall panels 148 can be respectively secured with the upper side rail assemblies 112A and 114B.

The infant playpen 100 can define a central axis X and a transversal axis Y. The central axis X can extend centrally between the two upper side rail assemblies 112A and 112B, and the upper side rail assemblies 112A and 112B can be symmetrical to each other with respect to the central axis X. The transversal axis Y can intersect the two joints 130 and 140 at the respective centers of the upper side rail assemblies 112A and 112B, and the segments 126 and 136 can be respectively symmetrical to the segments 128 and 138 with respect to the transversal axis Y.

Referring again to FIGS. 1 and 2, a removable accessory 150 can be detachably installed on the upper side rail assemblies 112A and 112B of the infant playpen 100. To facilitate the installation of the removable accessory 150, the upper side rail assemblies 112A and 112B can include a plurality of distinctive positioning regions 154, each of which can be configured to locate a connecting position of the removable accessory 150 on the infant playpen 100. According to the caregiver's needs, the removable accessory 150 can be installed on the infant playpen 100 in one or more configurations by selectively registering the removable accessory 150 with one or more of the positioning regions 154. The illustrated removable accessory 150 can exemplary be a portable infant bed, but other types of removable accessories (e.g., a changing station, a bassinet, a canopy, a toy bar, a storage tray and the like) may be installable on the infant playpen 100 by using the positioning regions 154.

There is no limitation on the number of the positioning regions provided on the infant playpen 100. In the illustrated embodiment of FIG. 2, the infant playpen 100 can have four positioning regions 154, which are respectively defined on the segments 126, 128, 136 and 138 of the two upper side rail assemblies 112A and 112B. The provision of multiple positioning regions 154 on the infant playpen 100 can allow a modular and flexible use in which different types of removable accessories (such as the removable accessory 150) can be desirably installed on the infant playpen 100 in different positions. In one embodiment, the positioning regions 154 can be arranged in a distribution that is symmetrical with respect to the central axis X: the positioning region 154 on the segment 126 and the positioning region 154 on the segment 136 can be placed symmetrical to each other with respect to the central axis X, and the positioning region 154 on the segment 128 and the positioning region 154 on the segment 138 can be symmetrical to each other with respect to the central axis X. Moreover, the distribution of the positioning regions 154 can further be symmetrical with respect to the transversal axis Y: the positioning regions 154 on the segments 126 and 128 can be symmetrical to each other with respect to the transversal axis Y, and the positioning regions 154 on the segments 136 and 138 can be symmetrical to each other with respect to the transversal axis Y. The distribution of the positioning regions 154 on the upper side rail assemblies 112A and 112B at two sides of the transversal axis Y can more efficiently use the perimeter of the infant playpen 100 for the placement of the removable accessory 150.

Figure 3:
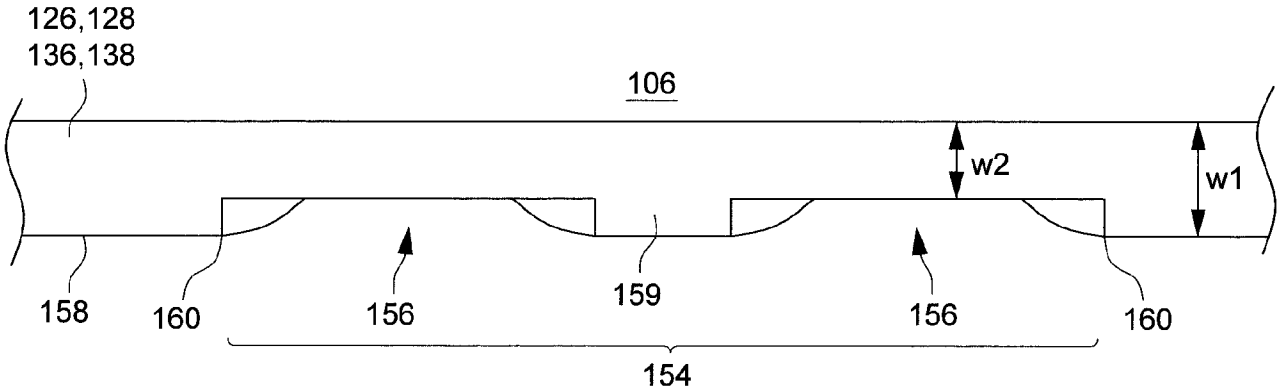
FIG. 3 is a schematically enlarged view illustrating the configuration of a positioning region provided on the frame structure of the infant playpen for attachment of a removable accessory.
Figure 4:
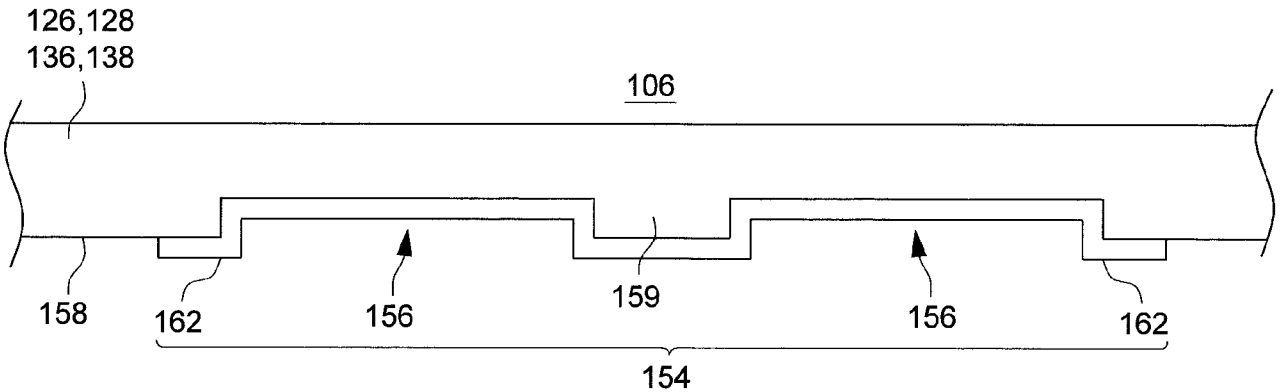
FIG. 4 is a schematically enlarged view illustrating a variant configuration of the positioning region.

In conjunction with FIG. 2, FIGS. 3 and 4 are enlarged views illustrating various configurations for each of the positioning regions 154. The positioning regions 154 can be identical in construction, each of which can operate to prevent displacement of the removable accessory 150 along the upper rail assemblies 112A and 112B. In one embodiment, each of the positioning regions 154 can be formed integral with the segments 126, 128, 136 and 138. As shown in FIG. 3, each of the positioning regions 154 can include one or more slot 156, which is formed on an outer surface 158 of the corresponding segment 126, 128, 136 or 138 and extends toward an interior thereof. In the illustrated embodiment, two slots 156 are exemplary provided spaced apart from each other by a segment portion 159 along a length of the segment 126, 128, 136 or 138. The slot 156 may be exemplary formed as a crushed area in the tubular segment, and can have a rim 160 that substantially conforms with the outer surface 158. Each of the segment 126, 128, 136 or 138 can have a first width w1 at locations between the two distal ends thereof that are outside the positioning regions 154, and a second width w2 at the positioning regions 154 that is smaller than w1.

In FIG. 4, a variant structure is shown in which the slots 156 may be defined in a socket 162 affixed with the segment 126, 128, 136 or 138. The socket 162 can fit snugly on each of the segment 126, 128, 136 and 138, and can be arranged with a limited extension above the outer surface 158 thereof. For example, a maximal height of the socket 162 above the outer surface 158 can be less than about 1.5 cm.

Each of the positioning regions 154 as described herein can thus be defined from a distinctive geometrical shape formed by an outer surface of the corresponding segment 126, 128, 136 or 138. Accordingly, the positioning regions 154 do not interfere with other components of the infant playpen 100, and tears or wearing of the fabric forming the enclosure 104 induced by frictional contact with the positioning regions can be prevented. Moreover, the appearance of the upper side rail assemblies 112A and 112B is not altered by the presence of the positioning regions. When the upper side rail assemblies 112A and 112B are pivotally folded about the joints 130 and 140 to collapse the infant playpen 100, the positioning regions 154 can remain on and move along with the respective segments 126, 128, 136 and 138.

Figure 5:
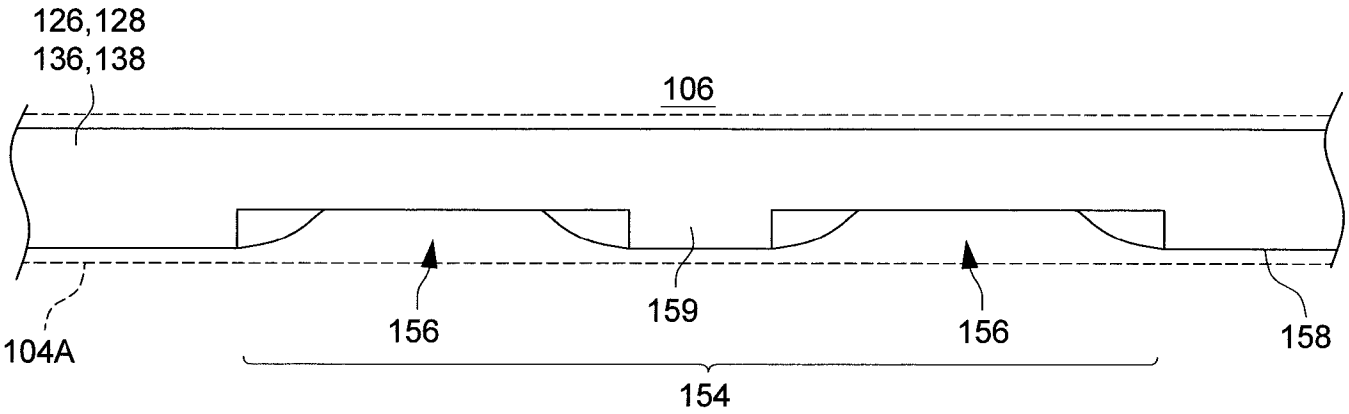
FIG. 5 is a schematic view illustrating the positioning region covered with a cloth material of an enclosure assembled in the infant playpen.

Referring to FIG. 5, the cloth material 104A of the enclosure 104 can respectively wrap around the segments 126, 128, 136 and 138 of the upper side rail assemblies 112A and 112B, and respectively covers the positioning regions 154 thereon. Some marking can be made on the cloth material of the enclosure 104 adjacent to the positioning regions 154 to visually indicate the respective locations of the positioning regions 154. When it is installed on the infant playpen 100, the removable accessory 150 can press against the cloth material of the enclosure 104 to engage with any of the positioning regions 154.

Figure 6:
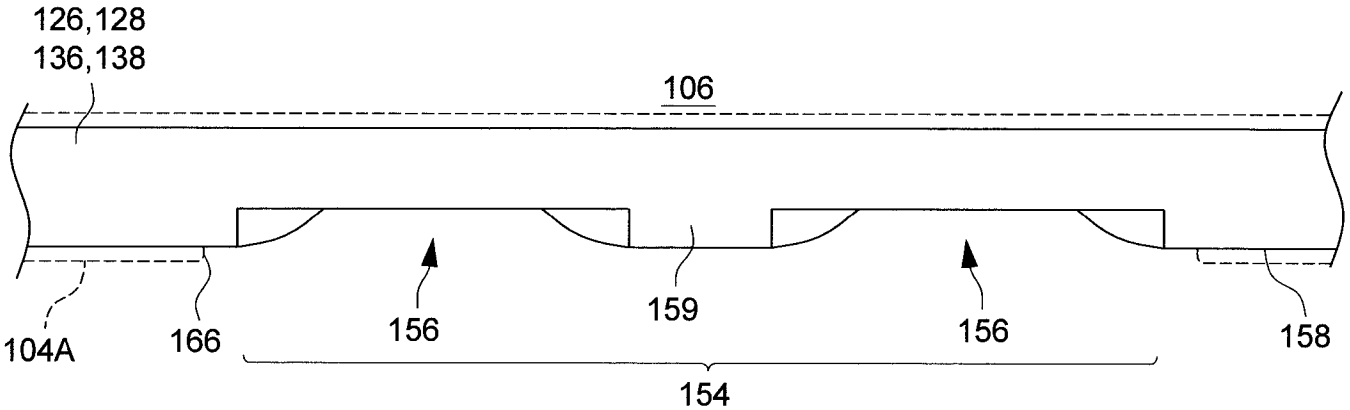
FIG. 6 is a schematic view illustrating the positioning region exposed through an opening formed through the cloth material of the enclosure assembled in the infant playpen.

FIG. 6 is a schematic view illustrating another embodiment in which the cloth material 104A of the enclosure 104 can respectively wrap around the segments 126, 128, 136 and 138 of the upper side rail assemblies 112A and 112B, and can be formed with an opening 166 at each location adjacent to one positioning region 154. When it is installed on the infant playpen 100, the removable accessory 150 can engage with any of the positioning regions 154 that are exposed through the openings 166.

Figure 7:
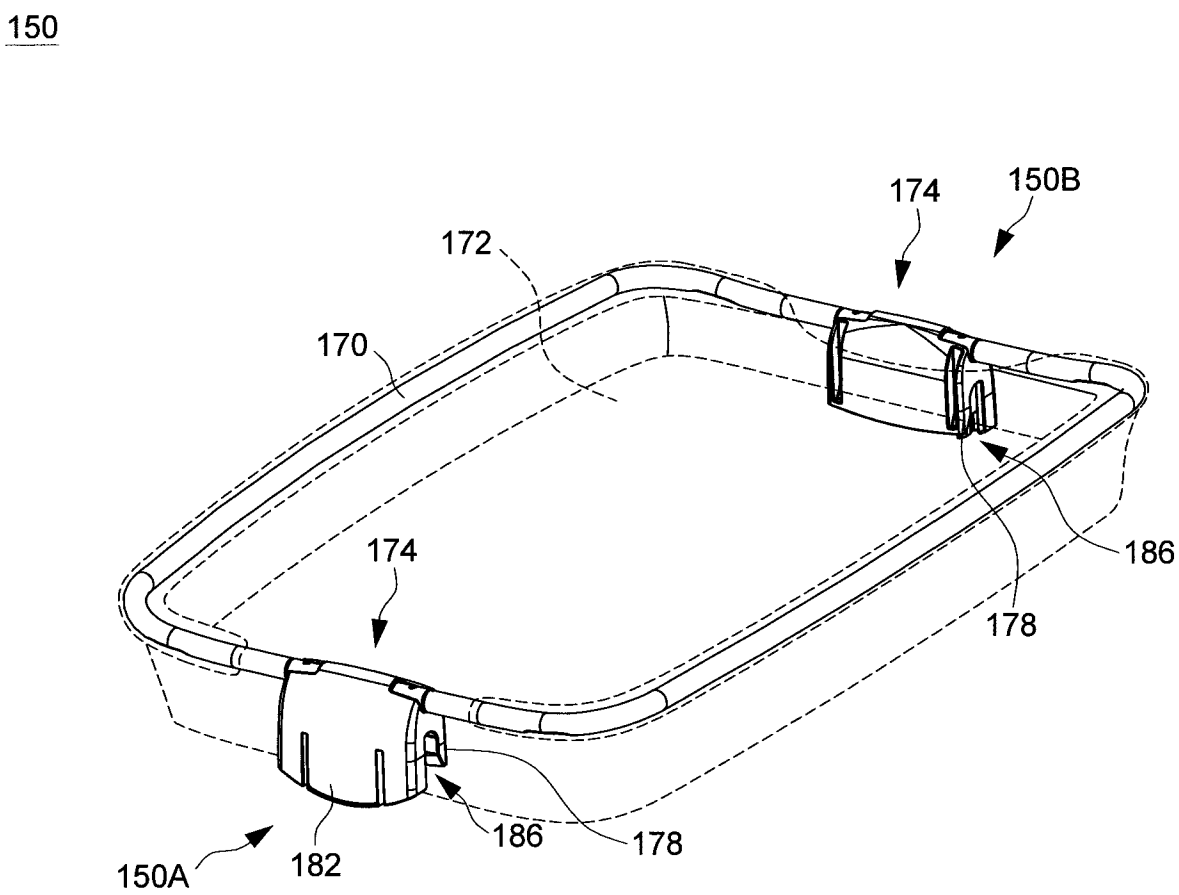
FIG. 7 is a schematic view illustrating the construction of a removable accessory.

FIG. 7 is a schematic view illustrating the construction of the removable accessory 150. The removable accessory 150 can include a support frame 170, a fabric material 172 (shown with phantom lines) assembled with the support frame 170, and two housings 174 respectively affixed with the support frame 170 at two opposite sides 150A and 150B of the removable accessory 150. The fabric material 172 can define a resting support on which a child can be placed. The housings 174 can connect with the upper side rail assemblies 112A and 112B when the removable accessory 150 is installed on the infant playpen 100. More specifically, each of the housings 174 can include a structure that can engage with one of the positioning regions 154, and is assembled with a locking part 176 (better shown in FIG. 8) that can lock with the corresponding upper side rail assembly 112A or 112B to prevent upward removal of the removable accessory 150. The two housings 174 and the locking parts 176 assembled therewith may be similar in construction.

Figure 8:
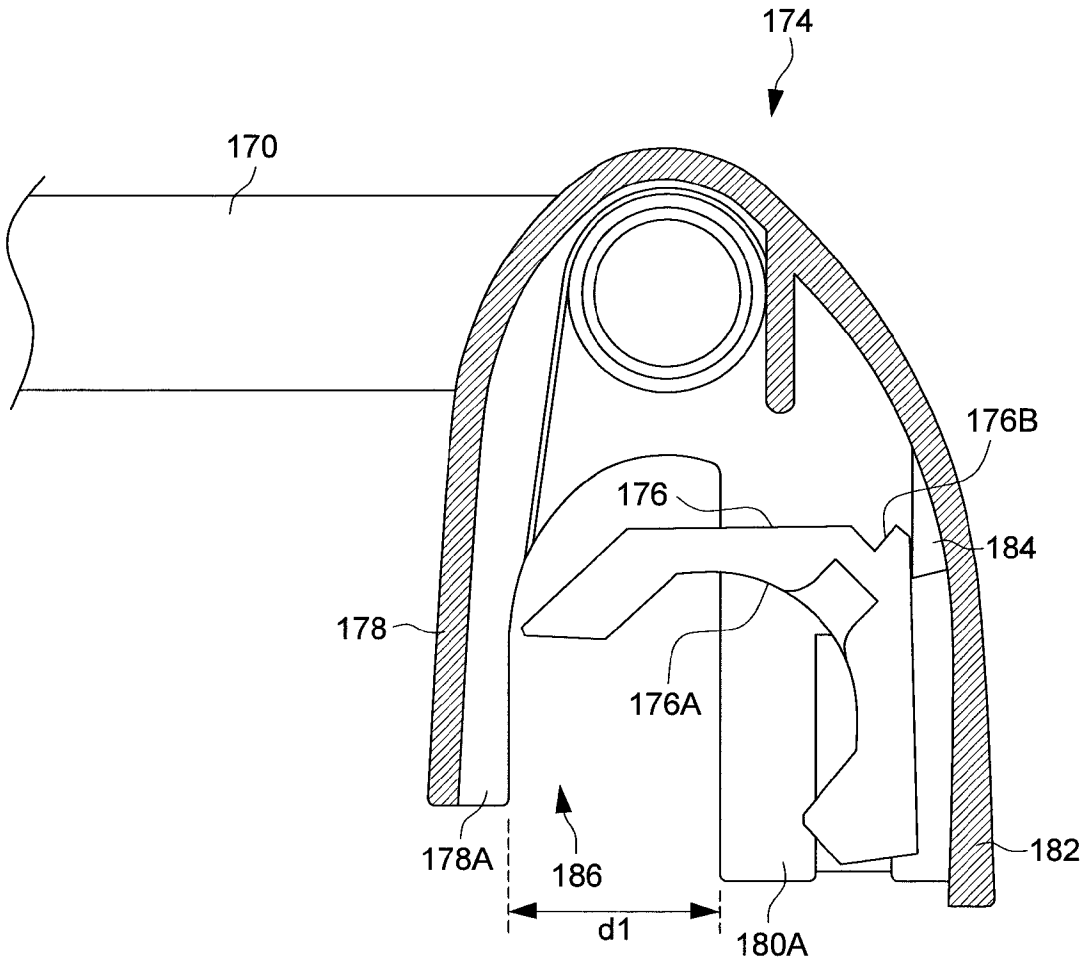
FIG. 8 is a schematic view illustrating a portion of the removable accessory including the assembly of a housing with a locking part configured to engage with one of the multiple positioning regions provided on the infant playpen.
Figure 9:
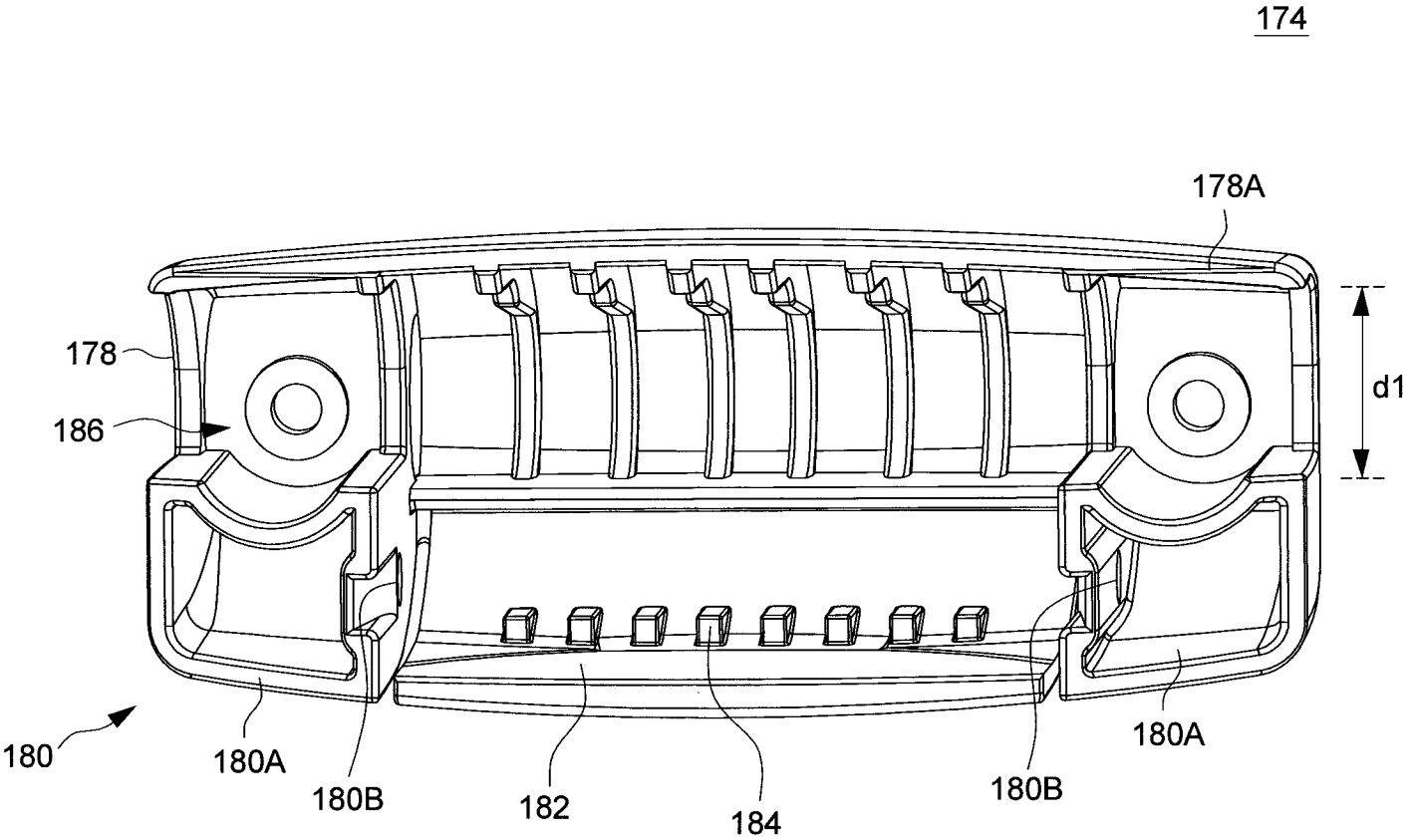
FIG. 9 is a schematic bottom view illustrating an inner structure of the housing.
Figure 10:
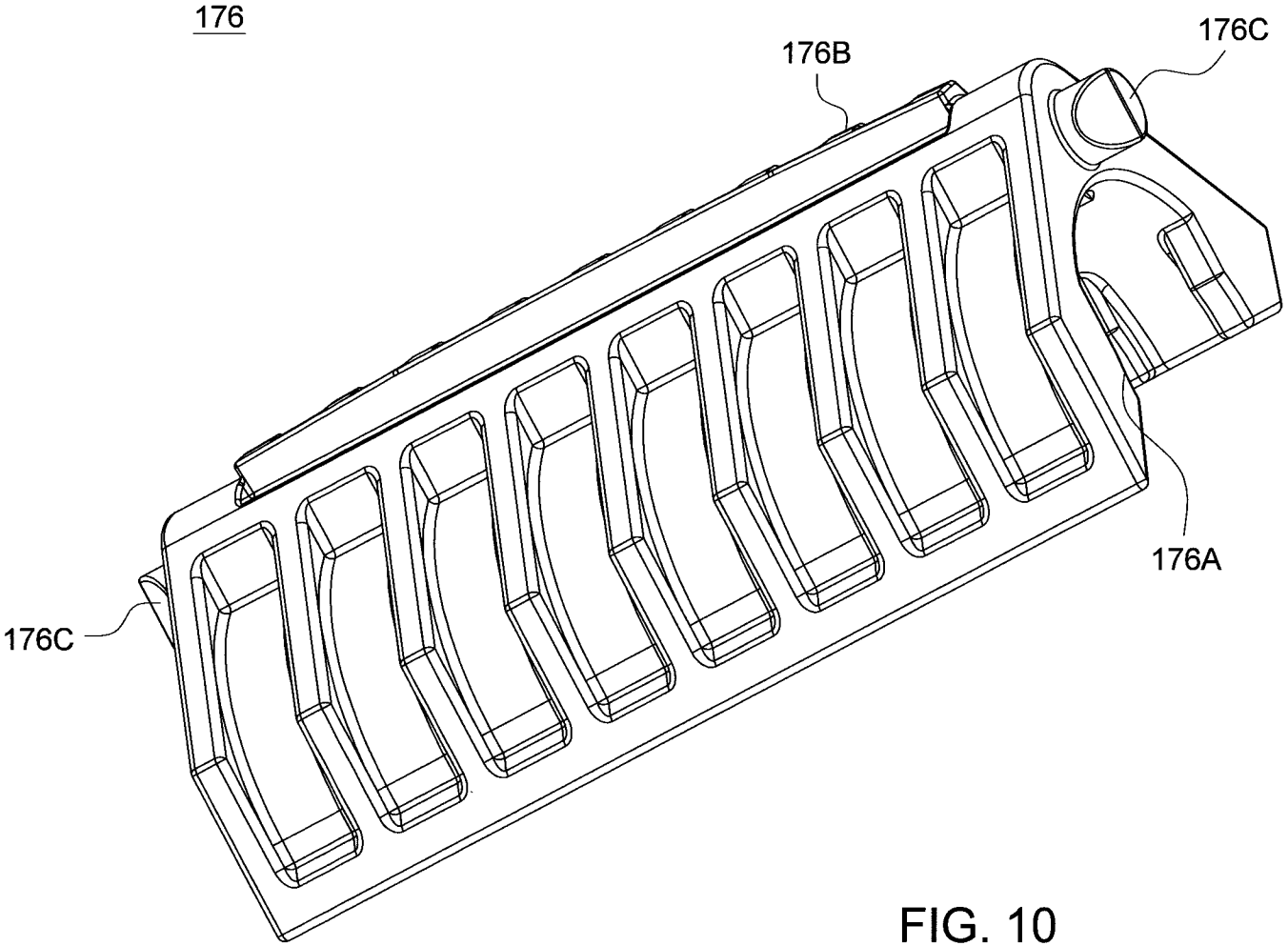
FIG. 10 is a schematic view of a locking part that can be assembled with the housing shown in FIG. 9.

In conjunction with FIG. 7, FIG. 8 is a schematic view illustrating the assembly of the housing 174 with the locking part 176, FIG. 9 is a schematic bottom view illustrating an inner structure of the housing 174 viewed from an underside, and FIG. 10 is a schematic view of the locking part 176. Referring to FIGS. 8-10, the housing 174 can have a saddle portion 178, a coupling structure 180, a resilient portion 182 and a retaining rib 184. The saddle portion 178 can have a U-shape, and can define a cavity 186 opened downward that is sized to receive therein any of the segments 126, 128, 136 and 138 and one corresponding positioning region 154. The coupling structure 180 can engage with any of the positioning regions 154 to prevent displacement of the removable accessory 150 along the upper side rail assemblies 112A and 112B. As shown, the coupling structure 180 can be formed integral with the housing 174, and include two protrusions 180A projecting toward the interior of the cavity 186 and face an opposite sidewall 178A of the saddle portion 178. Each of the protrusions 180A can be separated from the sidewall 178A by a gap distance d1 that is smaller than the width w1 (better shown in FIG. 3) of each of the segments 126, 128, 136 and 138. The resilient portion 182 can be formed integral with the housing 174 adjacent to the saddle portion 178, and can have an inner sidewall from which the retaining rib 184 protrudes toward the cavity 186.

The locking part 176 can be pivotally connected with the housing 174 adjacent to the saddle portion 178 and the cavity 186. In the illustrated embodiment, the locking part 176 can be arranged in the cavity 186 and can extend in a region between the two protrusions 180A of the coupling structure 180. Furthermore, each of the protrusions 180A can have a through hole 180B, and the locking part 176 can have shaft portions 176C protruding from opposite sides that are pivotally connected with the through holes 180B. The locking part 176 can have a C-shaped portion 176A, and a flange 176B protruding at a rear of the C-shaped portion 176A. The locking part 176 can rotate relative to the housing 174 between an unlocking position in which the flange 176B is disengaged from the retaining rib 184, and a locking position in which the flange 176B is engaged with the retaining rib 184 of the housing 174.

Figure 11:
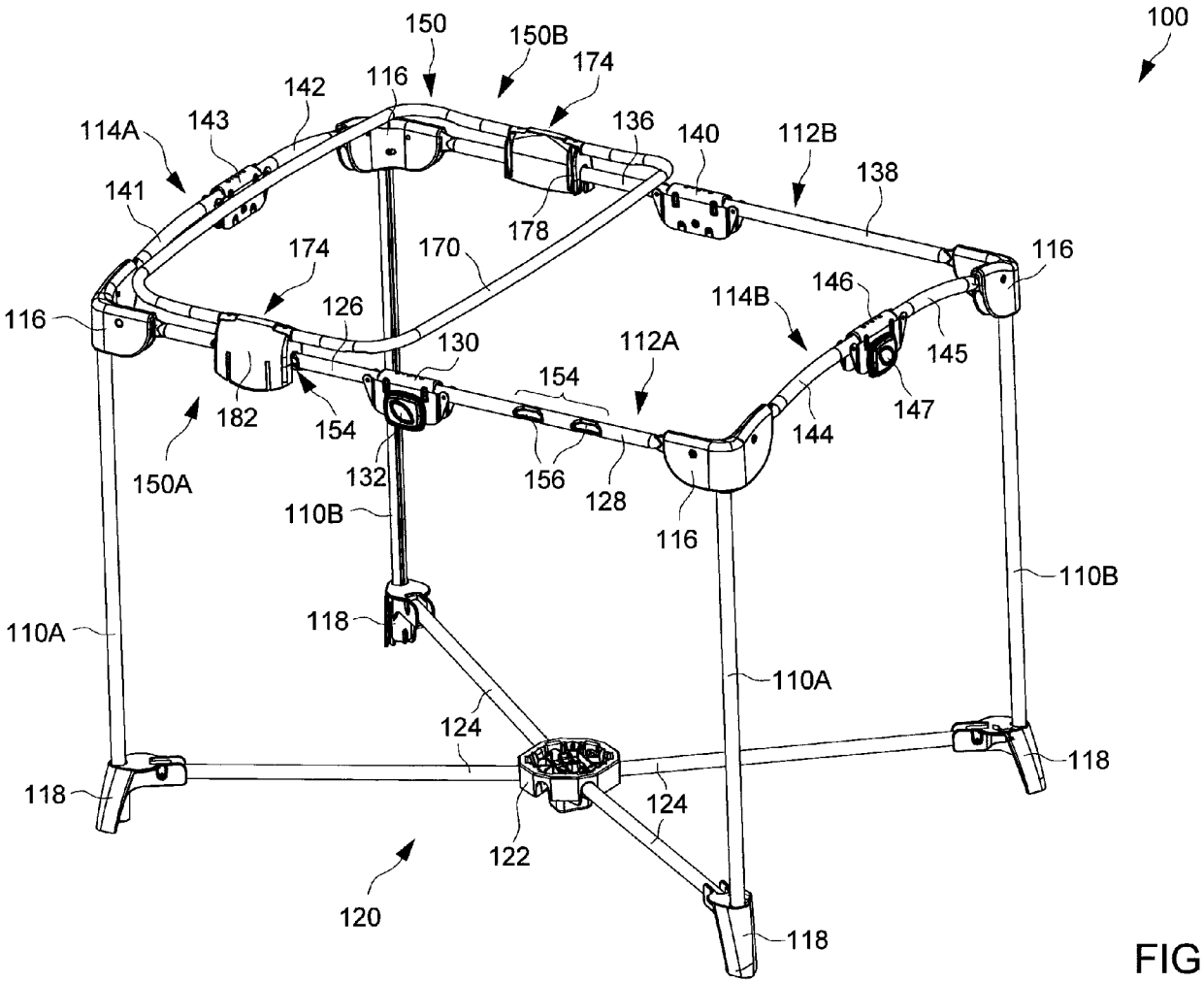
FIG. 11 is a schematic view illustrating the removable accessory installed on the infant playpen.
Figure 12:
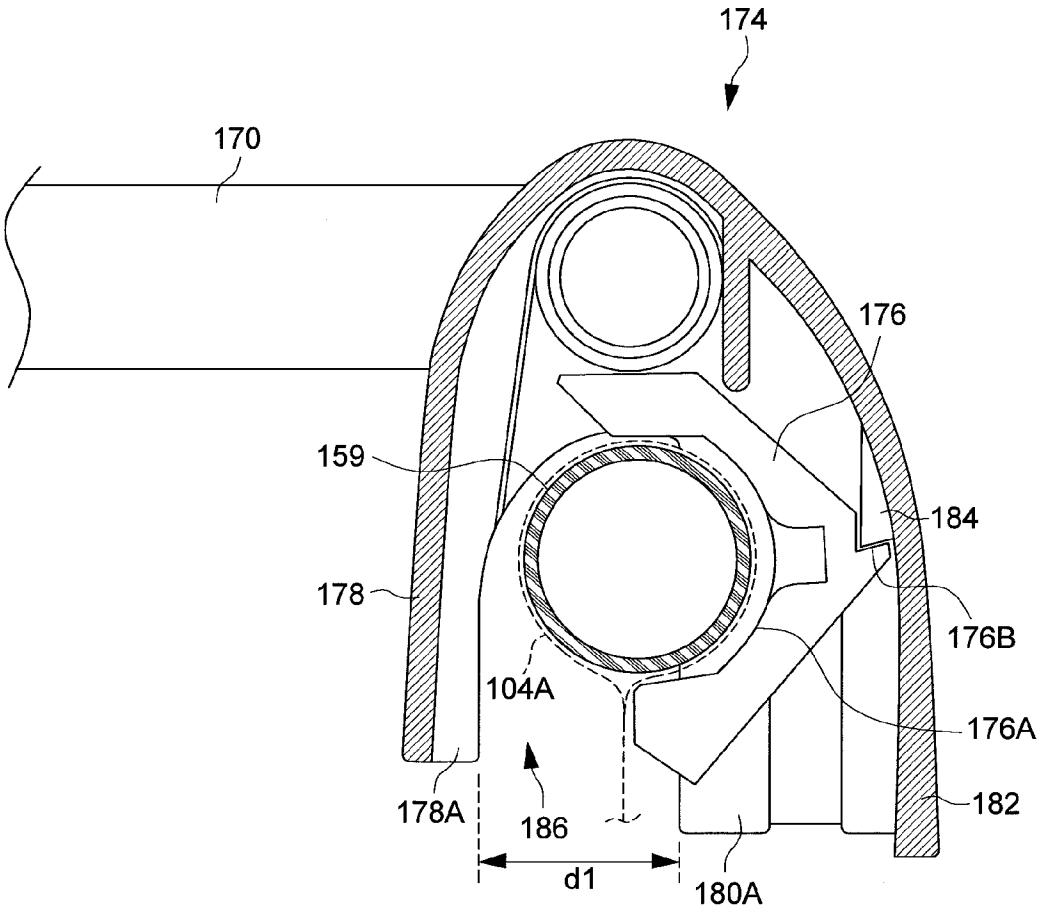
FIG. 12 is a schematic view illustrating the housing of the removable accessory locked with one of the positioning regions provided on the infant playpen.

In conjunction with FIGS. 7-10, FIG. 11 is a schematic view illustrating the removable accessory 150 is installed on the infant playpen 100, and FIG. 12 is a schematic view illustrating the housing 174 locked with one of the positioning regions 154 when the removable accessory 150 is installed on the infant playpen 100. For clarity, the representation of the fabric material on the removable accessory 150 and the cloth material on the infant playpen 100 are omitted in FIG. 11, and only rigid frame portions are illustrated.

In FIG. 11, the removable accessory 150 is exemplary shown as being installed on the infant playpen 100 with the housing 174 on the side 150A being locked with the positioning region 154 on the segment 126 of the upper side rail assembly 112A, and the housing 174 on the side 150B being locked with the positioning region 154 on the segment 136 of the upper side rail assembly 112B. The removable accessory 150 can be placed such that each of the two positioning regions 154 is inserted in the cavity 186 of the saddle portion 178. While the positioning region 154 is inserted in the saddle portion 178, the protrusions 180A of the coupling structure 180 can respectively slide vertically and engage through the slots 156 of the corresponding positioning region 154, which can prevent displacement of the removable accessory 150 along the upper side rail assemblies 112A and 112B. Moreover, referring to FIG. 12, the segment portion 159 can push the locking part 176 in rotation until the flange 176B engages with the retaining rib 184 and the C-shaped portion 176A of the locking part 176 engages the segment portion 159. The engagement of the flange 176B with the retaining rib 184 can hold the locking part 176 in the position corresponding to the locking state, and the locking part 176 in the locking state can wrap around the segment portion 159 and extend below the corresponding segment (e.g., each of segments 126 and 136) to retain the positioning region 154 in the saddle portion 178. Upward displacement of the removable accessory 150 can be thereby prevented.

It is worth noting that because the gap distance d1 between the sidewall 178A of the saddle portion 178 and each of the protrusions 180A of the coupling structure 180 is smaller than the width W1 of the segments 126, 128, 136 and 138, the housing 174 can be properly engaged only when it is correctly aligned with one positioning region 154. If the housing 174 were placed on any of the segments 126, 128, 136 and 138 at a location other than one positioning region 154, full insertion of the segment into the housing 174 would be blocked.

To remove the infant playpen 100 from the infant playpen 100, the resilient portion 182 is deflected outward (i.e., toward an outer side of the removable accessory 150) to disengage the retaining rib 184 from the flange 176B of the locking part 176. The removable accessory 150 then can be pulled upward, which causes the protrusions 180A of the coupling structure 180 to disengage from the slots 156 of the corresponding positioning region 154. While the removable accessory 150 is displaced upward, the positioning region 154 can push the locking part 176 to rotate to the unlocking position and can move outside the saddle portion 178 of the housing 174. The removable accessory 150 can be thereby removed from the infant playpen 100.

Figure 13:
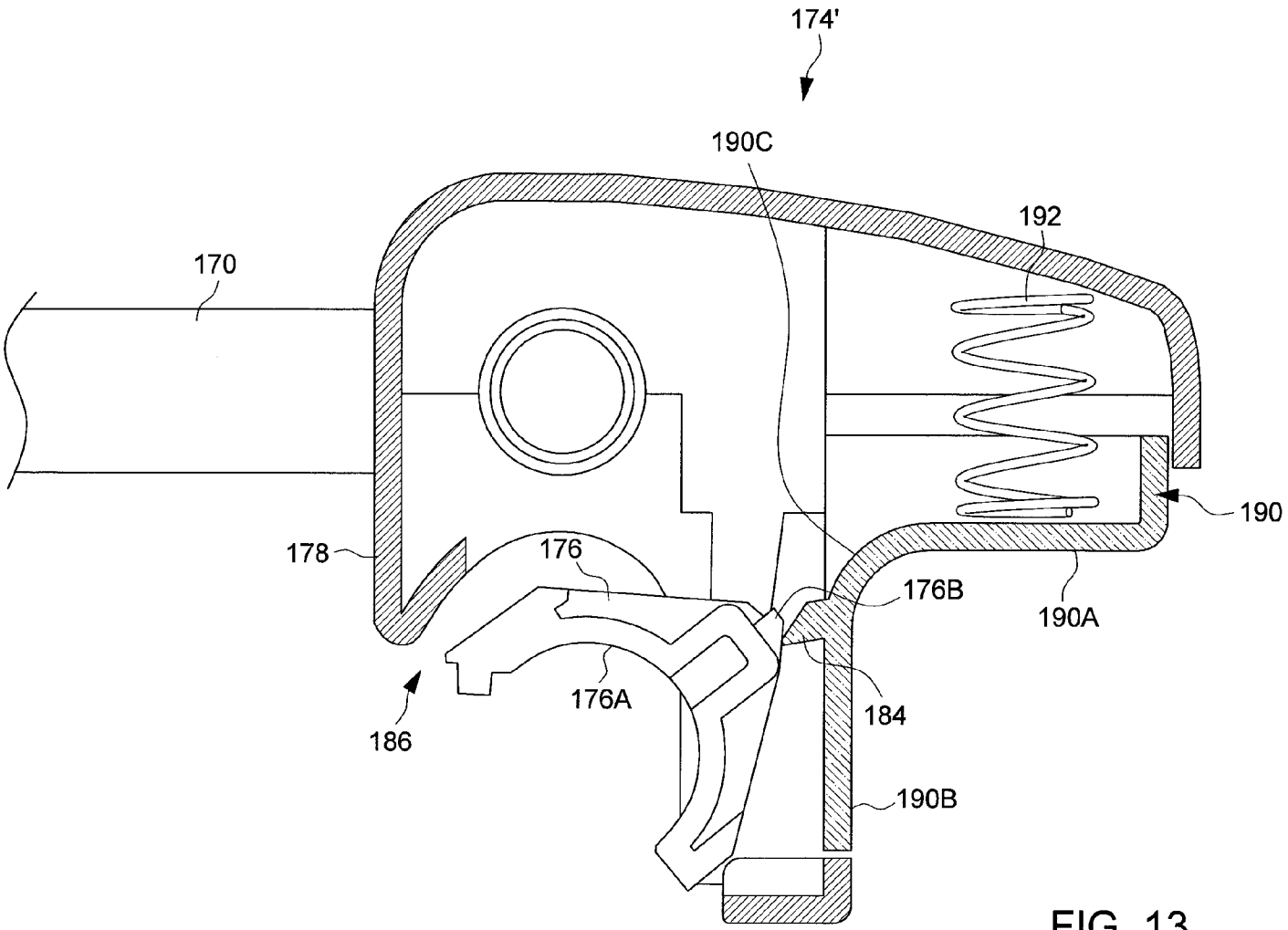
FIGS. 13 and 14 are schematic views illustrating a variant embodiment of a lock mechanism assembled with the housing of the removable accessory.
Figure 14:
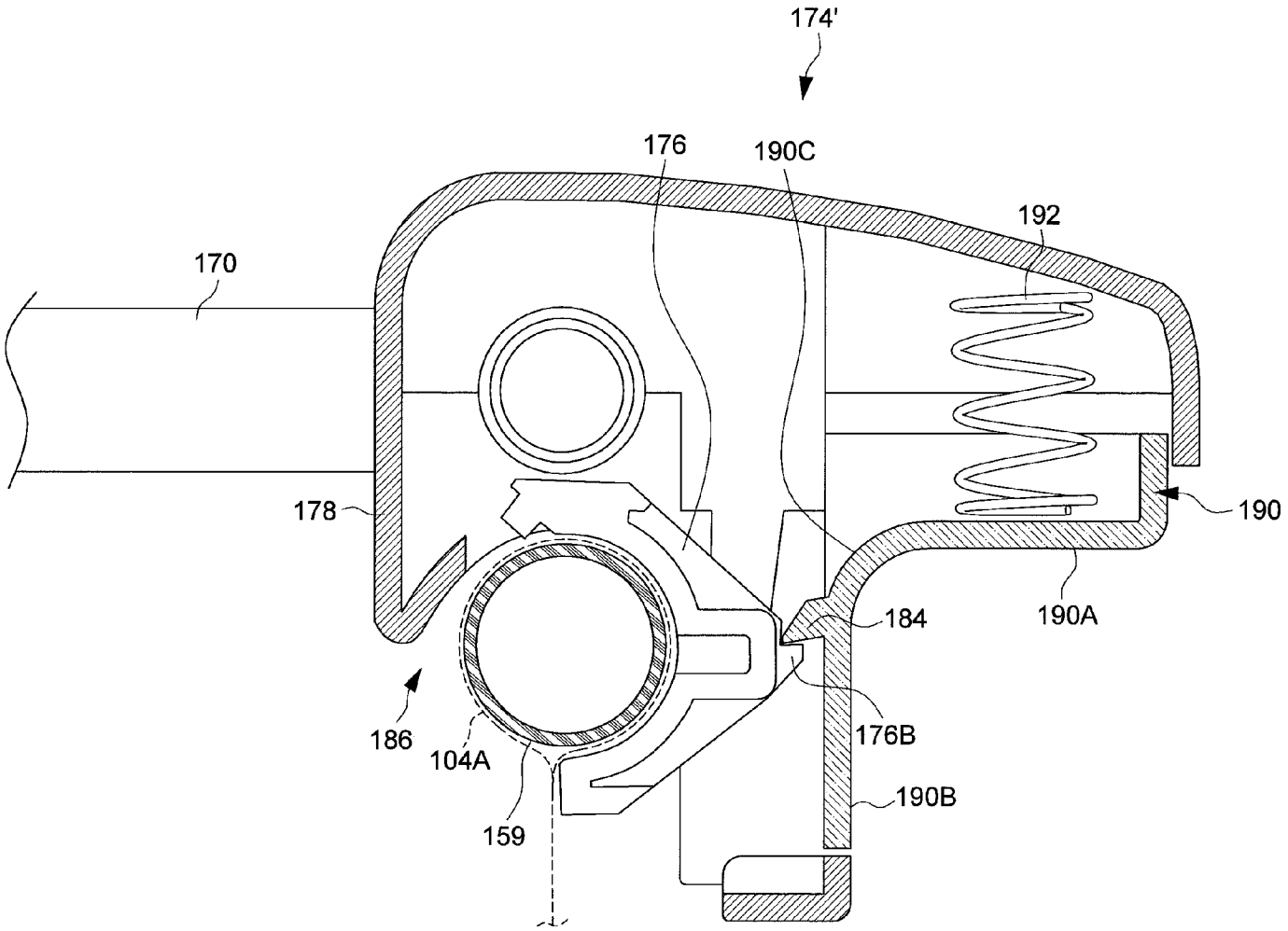

FIGS. 13 and 14 are schematic views illustrating a variant embodiment of the lock mechanism assembled with the housing 174' of the removable accessory 150. Like previously described, the housing 174' can have the saddle portion 178 formed with the cavity 186. However, the housing 174' shown in FIGS. 13 and 14 differs from the one described previously in that it has no resilient portion 182. Instead, the housing 174' is pivotally connected with a release button 190 having a reverse L-shape, and the retaining rib 184 is formed on an inner sidewall of the release button 190. The release button 190 can be formed in an integral body having two portions 190A and 190B that are connected with each other at an angle, and the pivot connection of the release button 190 with the housing 174' can be adjacent to a joining region 190C between the two portions 190A and 190B. The retaining rib 184 can be formed on an inner surface of the portion 190B of the release button 190. Moreover, a spring 192 can be respectively connected with the portion 190A of the release button 190 and an inner sidewall of the housing 174'.

When the housing 174' is attached with one of the positioning regions 154, the locking part 176 likewise engages with the segment portion 159 and is held in the locking position by engagement of the retaining rib 184 with the flange 176B. To remove the accessory 150 from the infant playpen 100, the portion 190A of the release button 190 can be pushed upward, which causes the release button 190 to rotate relative to the housing 174' in a direction that disengages the retaining rib 184 from the flange 176B of the locking part 176 and compresses the spring 192. The axis about which the release button 190 rotates relative to the housing 174' can be substantially parallel to the segment portion 159. The removable accessory 150 then can be pulled upward, which causes the protrusions 180A of the coupling structure 180 to disengage from the slots 156 of the corresponding positioning region 154. While the removable accessory 150 is displaced upward, the positioning region 154 can push the locking part 176 to rotate to the unlocking position and move outside the saddle portion 178 of the housing 174'. Once the removable accessory 150 is removed from the infant playpen 100, the spring 192 can bias the release button 190 to its initial position.

Figure 15:
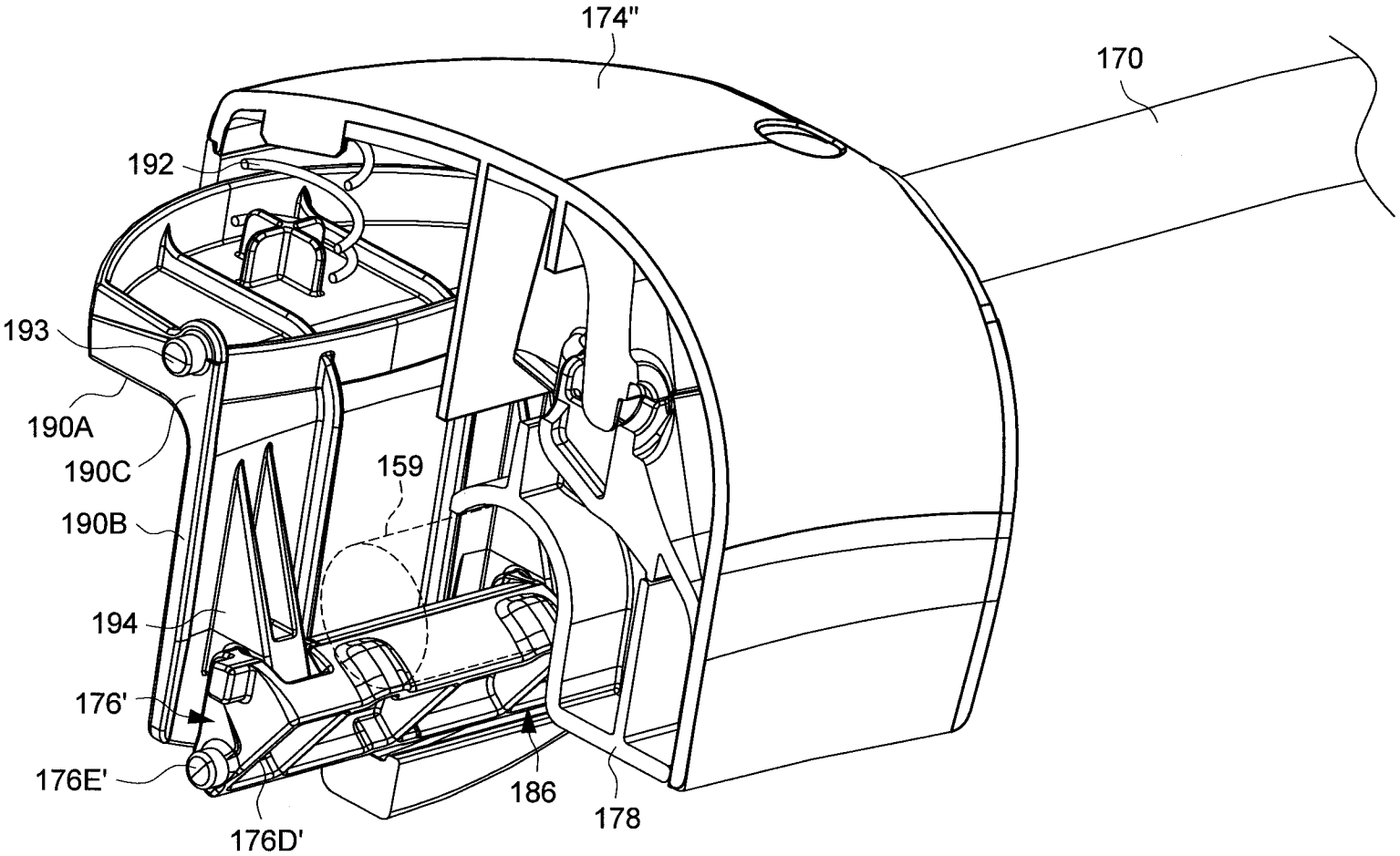
FIG. 15 is a schematic view illustrating another embodiment of a lock mechanism assembled with the housing of the removable accessory.

FIG. 15 is a schematic view illustrating another embodiment of the lock mechanism assembled with a housing 174" of the removable accessory 150. Like previously described in FIGS. 13 and 14, the housing 174" can have the saddle portion 178 formed with the cavity 186, and is pivotally connected with the release button 190 having a reverse L-shape. The pivotal connection of the release button 190 with the housing 174" may be realized through posts 193 located adjacent to the joining region 190C that are received in recesses (not shown) provided in the housing 174". As shown in FIG. 15, the portion 190B of the release button 190 can be connected with a locking part 176' having a ramp surface 176D'. The locking part 176' can have protruding posts 176E' that are pivotally connected with the housing 174" about a pivot axis spaced apart from the pivot axis of the release button 190. Moreover, the portion 190B of the release button 190 can be formed with an arm 194 that projects inward and is connected with the locking part 176' at a location offset from the pivot axis of the locking part 176'. Rotation of the release button 190 can thus drive a rotational displacement of the locking part 176' owing to the connection of the arm 194 with the locking part 176'.

When the housing 174" is installed on one of the positioning regions 154, the segment portion 159 of the positioning region 154 can be inserted in the saddle portion 178 and push against the ramp surface 176D' so as to cause respective rotations of the locking part 176' and the release button 190 against the spring force exerted by the spring 192. Once the segment portion 159 (as shown with phantom lines) is fully inserted in the saddle portion 178, the spring 192 can urge the release button 190 to rotate, which in turn drives a rotational displacement of the locking part 176' to engage underneath the segment portion 159 and lock the segment portion 159 in place. To remove the accessory 150 from the infant playpen 100, the portion 190A of the release button 190 can be pushed upward, which causes the release button 190 to rotate in a direction that drives the locking part 176' to disengage from underneath the segment portion 159. The removable accessory 150 then can be pulled upward, which removes the positioning region 154 from the housing 174".

Figure 16:
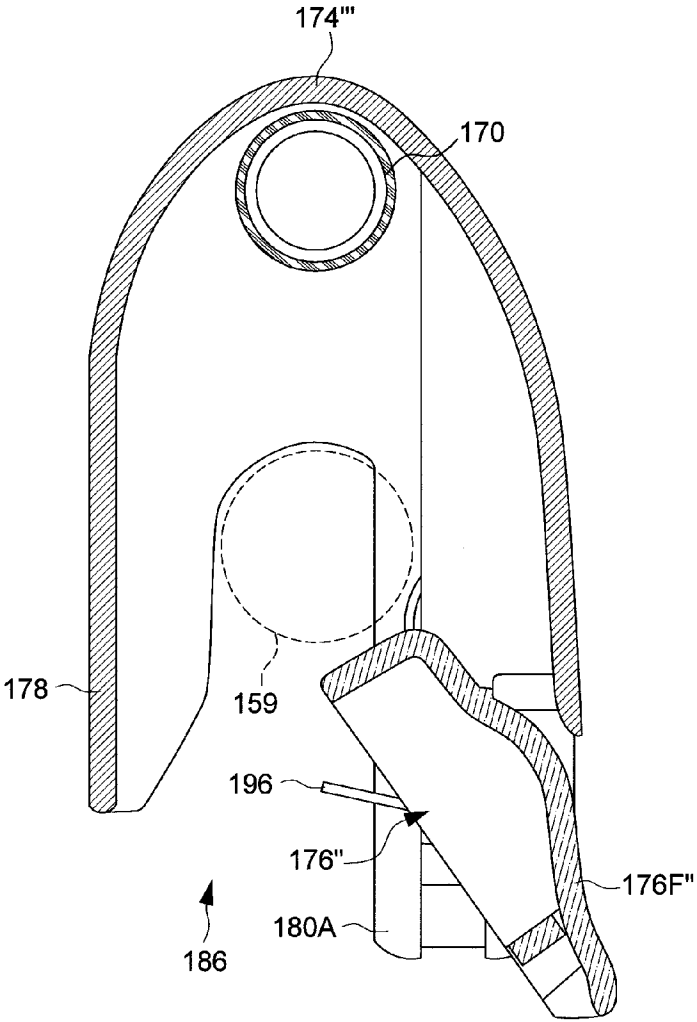
FIG. 16 is a schematic view illustrating another variant embodiment of a lock mechanism assembled with the housing of the removable accessory

FIG. 16 is schematic view illustrating another variant embodiment of a lock mechanism assembled with a housing 174' of the removable accessory 150. Like previously described, the housing 174'" can have the saddle portion 178 for receiving one positioning region 154 of the infant playpen 100, and can be pivotally connected with a locking part 176". However, no release button 190 and no spring 192 are provided in the embodiment shown in FIG. 16. Instead, the locking part 176" has an actuating portion 176F" that is exposed outward for operation. Moreover, a spring 196 can be connected with the locking part 176". The spring 196 can rotationally bias the locking part 176" to a locking state. When the housing 174' is installed on one of the positioning regions 154, the segment portion 159 of the positioning region 154 can be inserted in the saddle portion 178 and push against the locking part 176" so as to cause its rotational displacement against the biasing force exerted by the spring 196. Once the segment portion 159 is fully inserted in the saddle portion 178, the spring 196 can urge the locking part 176" to engage underneath the segment portion 159 and lock the segment portion 159 in place. To remove the accessory 150 from the infant playpen 100, the actuating portion 176F" of the locking part 176" can be pushed toward the interior of the housing 174'", which causes the locking part 176" to rotate and disengage from underneath the segment portion 159. The removable accessory 150 then can be pulled upward, which removes the positioning region 154 from the housing 174'".

Figure 17:
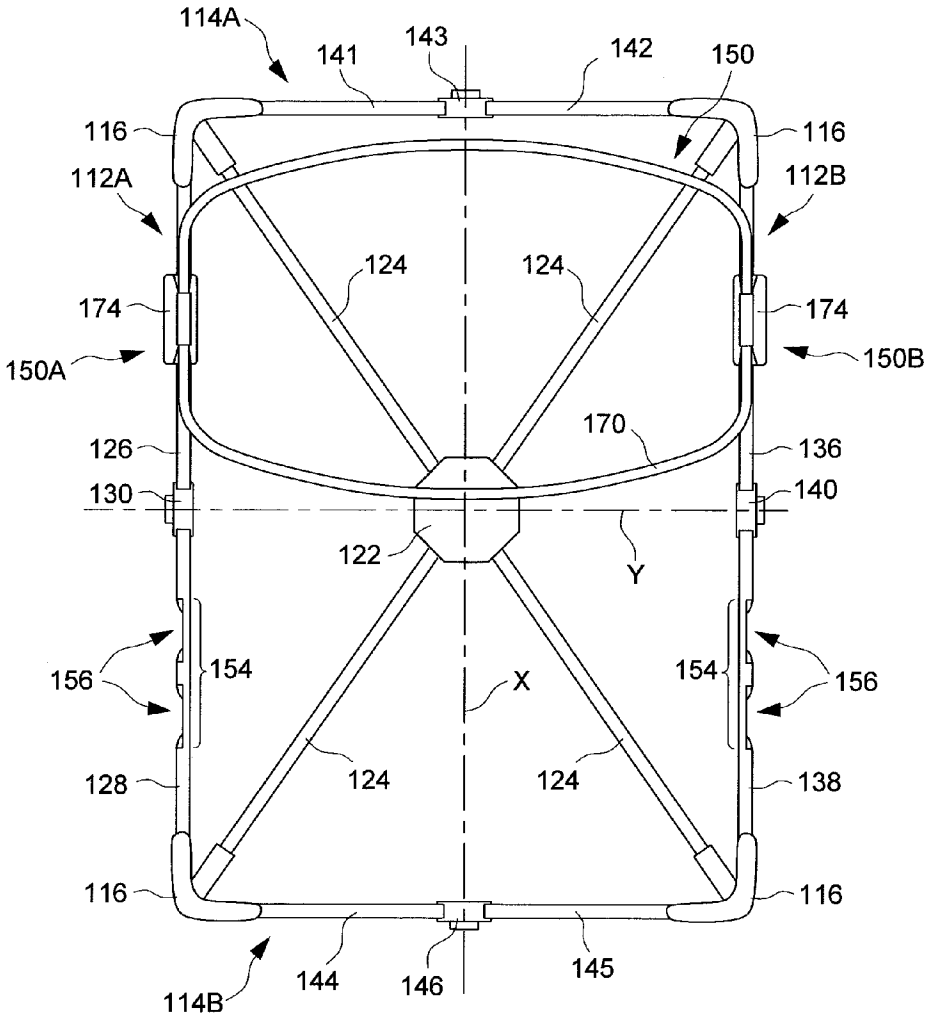
FIG. 17 is a schematic view illustrating the removable accessory installed on the infant playpen in a first configuration where it occupies a first half of the infant playpen.
Figure 18:
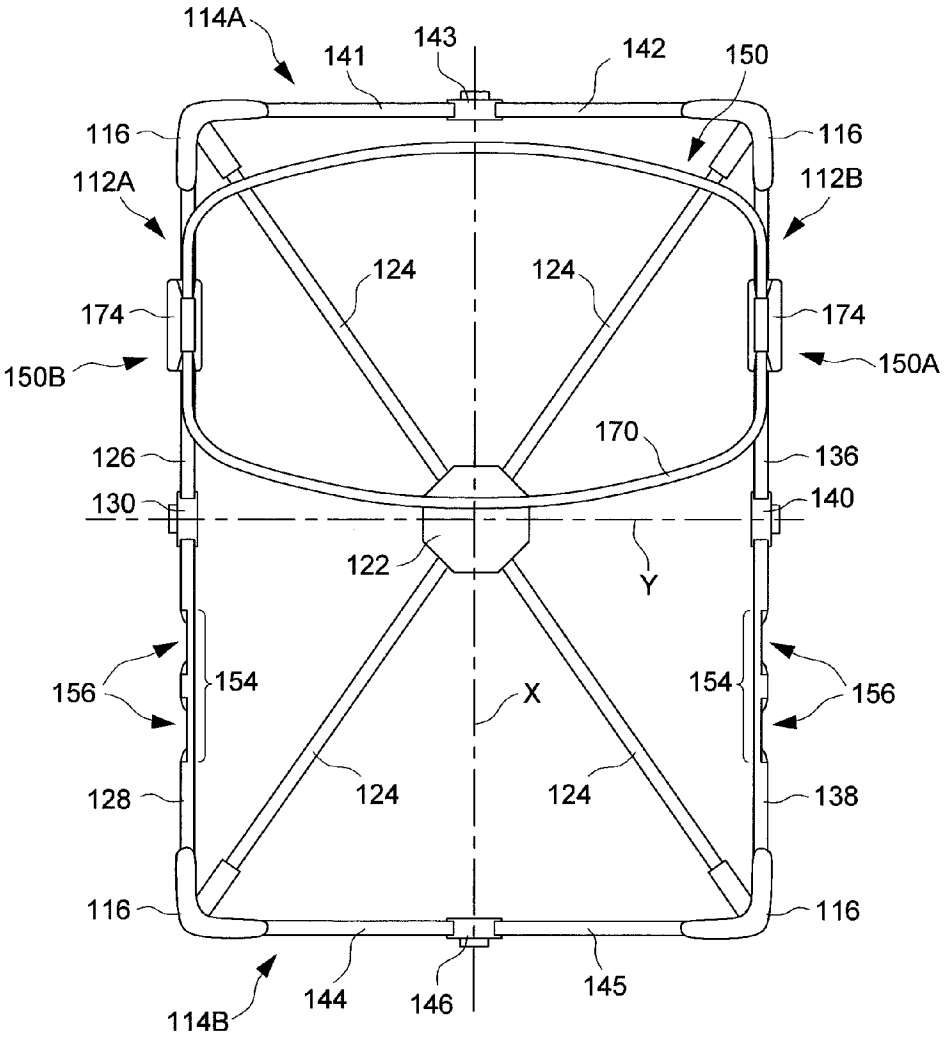
FIG. 18 is a schematic view illustrating the removable accessory installed on the infant playpen in a second configuration in which the removable accessory is rotated 180 degrees relative to the first configuration.

FIGS. 17-22 are schematic views illustrating different configurations of removable accessories installed on the infant playpen 100 infant carrier system. In FIGS. 17 and 18, the removable accessory 150 is shown as being installed on the infant playpen 100 in two configurations. Referring to FIG. 17, a first configuration is shown in which the housing 174 on the side 150A of the removable accessory 150 is locked with the positioning region 154 on the segment 126 of the upper side rail assembly 112A, and the housing 174 on the side 150B of the removable accessory 150 is locked with the positioning region 154 on the segment 136 of the upper side rail assembly 112B. Referring to FIG. 18, a second configuration is shown in which the housing 174 on the side 150A of the removable accessory 150 is locked with the positioning region 154 on the segment 136 of the upper side rail assembly 112B, and the housing 174 on the side 150B of the removable accessory 150 is locked with the positioning region 154 on the segment 126 of the upper side rail assembly 112A. In other words, the position of the removable accessory 150 as shown in FIG. 18 is rotated 180 degrees with respect to that shown in FIG. 17.

Figure 19:
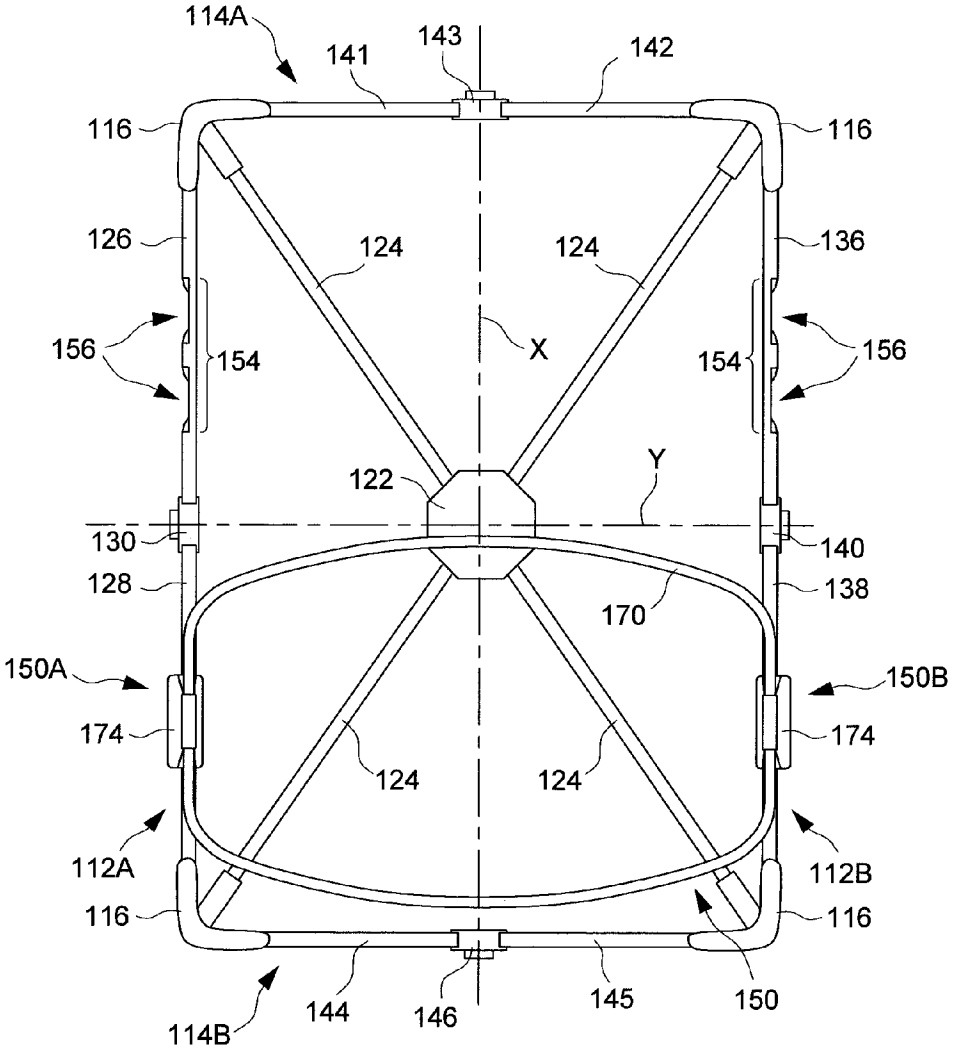
FIG. 19 is a schematic view illustrating the removable accessory installed on the infant playpen in another configuration where it occupies a second half of the infant playpen compared to that shown in FIG. 17.

In FIG. 19, the removable accessory 150 is shown as being installed on the infant playpen 100 in another configuration in which the housing 174 on the side 150A of the removable accessory 150 is locked with the positioning region 154 on the segment 128 of the upper side rail assembly 112A, and the housing 174 on the side 150B of the removable accessory 150 is locked with the positioning region 154 on the segment 138 of the upper side rail assembly 112B. The removable accessory 150 as shown in FIG. 19 thus occupies a second half of the infant playpen 100, whereas it is placed on a first half of the infant playpen 100 in FIG. 17.

Figure 20:
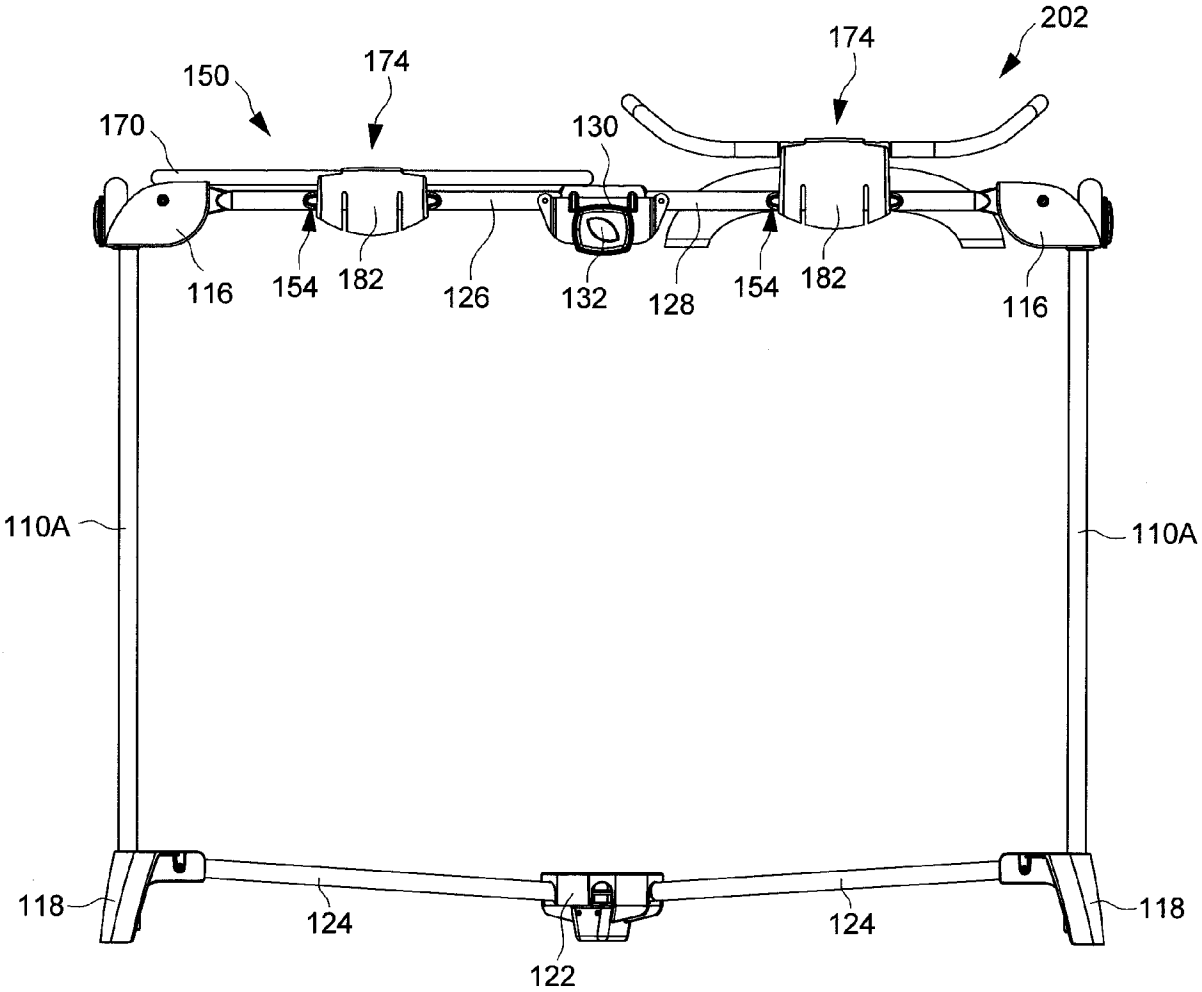
FIG. 20 is a schematic view illustrating two removable accessories are installed side-by-side on the infant playpen.
Figure 21:
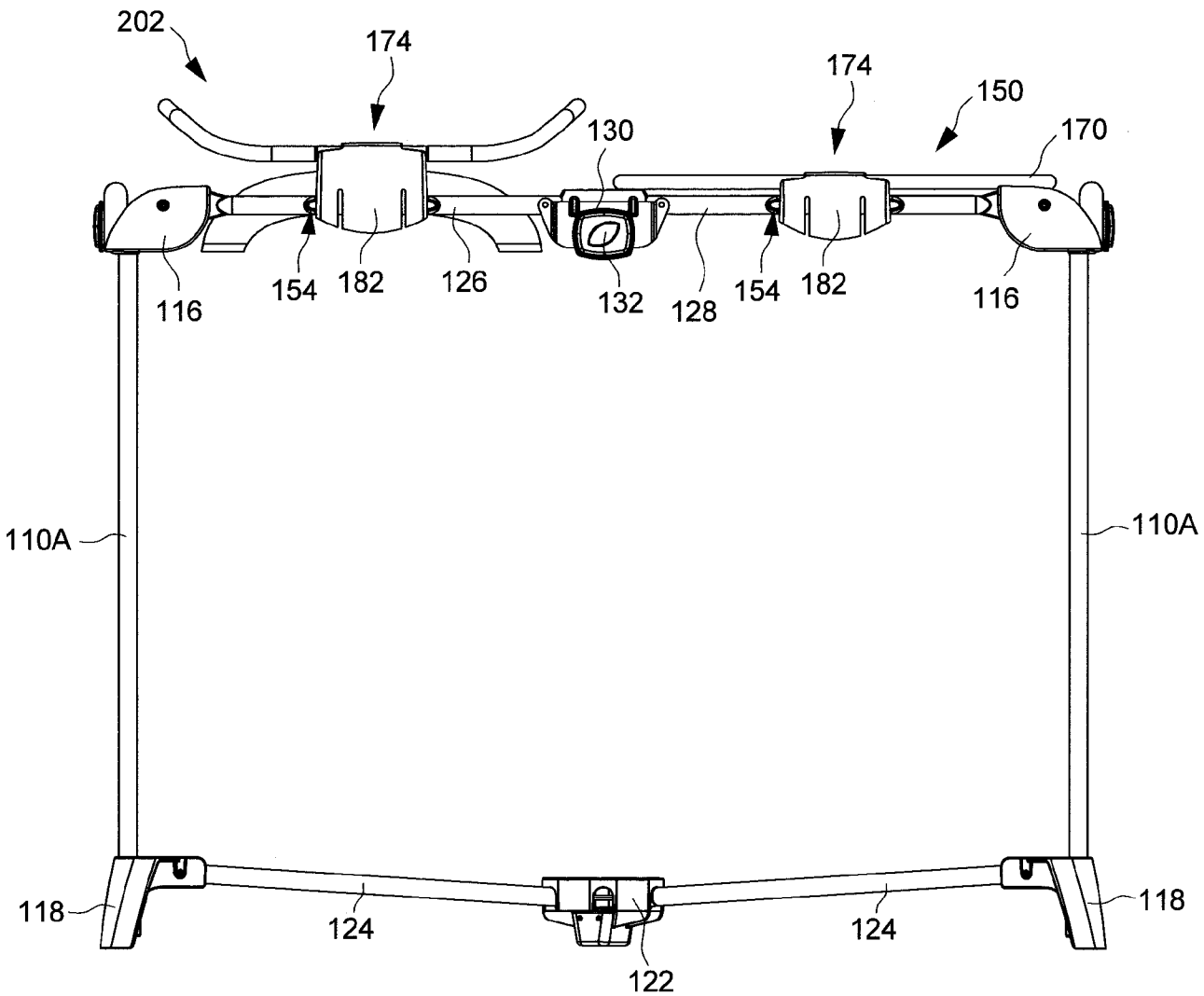
FIG. 21 is a schematic view illustrating the two removable accessories installed side-by-side on the infant playpen at interchanged positions compared to FIG. 20.

In FIGS. 20 and 21, the removable accessory 150 and another removable accessory 202 are shown as being installed side-by-side on the infant playpen 100. More specifically, the removable accessory 150 is shown in FIG. 20 as being installed on the infant playpen 100 in a configuration in which the housing 174 on the side 150A of the removable accessory 150 is locked with the positioning region 154 on the segment 126 of the upper side rail assembly 112A, and the housing 174 on the side 150B of the removable accessory 150 is locked with the positioning region 154 on the segment 136 of the upper side rail assembly 112B. Moreover, another removable accessory 202 (e.g., a changing station) can be also be installed on the infant playpen 100 side-by-side with respect to the removable accessory 150. The removable accessory 202 can exemplary include the assembly of two housings 174 as described previously, which can respectively attached to the positioning regions 154 on the segment 128 of the upper side rail assembly 112A and the segment 138 on the upper side rail assembly 112B. In FIG. 21, the removable accessories 150 and 202 are shown as being installed on the infant playpen 100 at interchanged positions compared to the configuration shown in FIG. 20.

Figure 22:
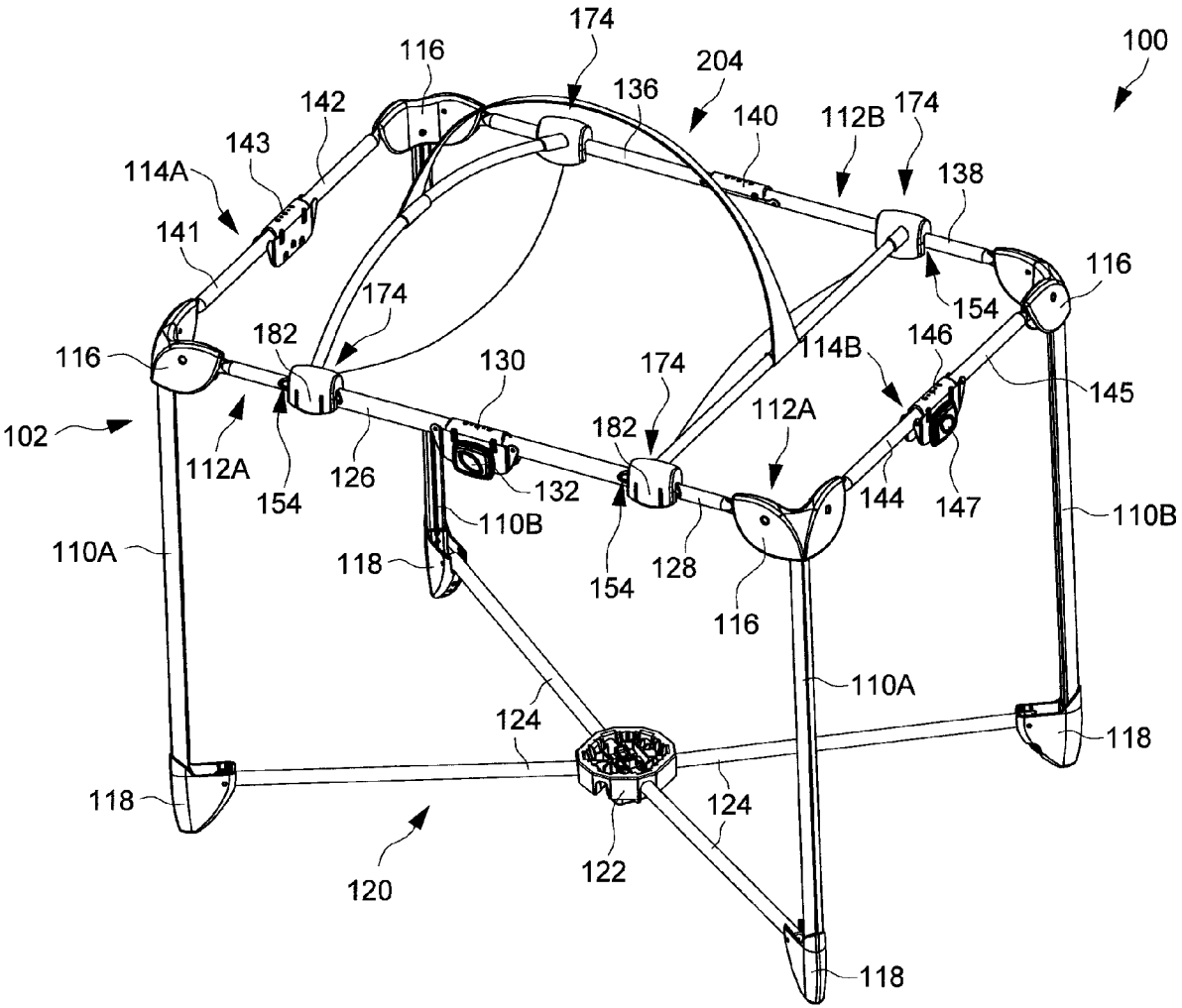
FIG. 22 is a schematic view illustrating a removable accessory installed on the infant playpen by engaging with all of the positioning regions thereon.

In FIG. 22, another removable accessory 204 (e.g., a napper device) is shown as being provided with four housings 174 distributed on two opposite sides. The removable accessory 204 is installed on the infant playpen 100 by engaging the four housings 174 with all of the four positioning regions 154. As a result, the installed removable accessory 204 can extend past the joints 130 and 140 of the upper side rail assemblies 112A and 112B.

It is worth noting that any types of removable accessories provided with the housing 174 (or 174', 174" or 174'") and the locking part as described previously can be installed on the infant playpen 100 in the same manner. Examples of removable accessories can include, without limitation, a changing station, a napper device, a bassinet, a canopy, a toy bar, a storage tray and the like. Moreover, it can be understood that the upper side rail assemblies 114A and 114B can be also provided with positioning regions 154 should the placement of removable accessories thereon be needed.

While the aforementioned embodiments have been described with respect to collapsible infant playpens, the same features and advantages may be implemented in any infant playpens in general. For example, FIG. 23 is a schematic view illustrating a playpen frame 202 in which all of the upper side rail assemblies 212A, 212B, 214A and 214B are not foldable. The upper side rail assembly 212A can be formed by one elongated tubular segment 226 having two distal ends respectively connected with two corner joints 116, and the upper side rail assembly 212B can be formed by one elongated tubular segment 236 that is parallel to the segment 226 and has two distal ends respectively connected with two other corner joints 116 at a side opposite to that of the segment 226. Likewise, the upper side rail assembly 214A can be formed by one elongated tubular segment 242 having two distal ends respectively connected with two corner joints 116, and the upper side rail assemblies 214B can be formed by one elongated tubular segment 244 having two distal ends respectively connected with two other corner joints 116 at a side opposite that of the elongated segment 242.

Like the upper side rail assemblies 112A and 112B previously described, positioning regions 154 comprised of slots 156 can be defined on the segments 226 and 236 of the upper side rail assemblies 212A and 212B according to a distribution symmetrical to the axes X and Y. Moreover, additional positioning regions 154 can also be defined on the segments 242 and 244 of the upper side rail assemblies 214A and 214B.

Advantages of the structures described herein include the ability to provide an infant playpen that has multiple positioning regions capable of receiving the installation of multiple removable accessories in diverse configurations. Accordingly, the connection between the infant playpen and the removable accessories can be standardized, and all removable accessories can be installed on the infant playpen using the same connection positions and connection mechanism. When the removable accessory is detached from the infant playpen, no disassembly of the positioning regions is required, and the positioning regions can conveniently remain on the infant playpen. The positioning regions are compactly affixed on the upper side rail assemblies of the infant playpen, and do not interfere with the use and operation of the infant playpen.

Realizations of the infant playpen and related accessories have been described in the context of particular embodiments. These embodiments are meant to be illustrative and not limiting. Many variations, modifications, additions, and improvements are possible. These and other variations, modifications, additions, and improvements may fall within the scope of the inventions as defined in the claims that follow.

What is claimed is:

1. An infant playpen comprising:

a plurality of upright legs; and a first and a second upper side rail assembly supported by the upright legs, wherein each of the first and second upper side rail assemblies includes at least one elongated segment having an outer surface, and a plurality of positioning regions are defined on the outer surfaces of the elongated segments, each of the positioning regions being configured to locate a connection of a removable accessory on the infant playpen, and at least one of the positioning regions including two slots that are formed on the outer surface of the corresponding segment and are spaced apart from each other along a length of the corresponding segment.

2. The infant playpen according to claim 1, wherein the first upper side rail assembly includes a first and a second segment pivotally connected with a first joint, the second upper side rail assembly includes a third segment and a fourth segment pivotally connected with a second joint, and the positioning regions include four positioning regions respectively distributed on the first, second, third and fourth segments.

3. The infant playpen according to claim 1, wherein the positioning regions are respectively formed with the outer surfaces of the elongated segments.

4. The infant playpen according to claim 1, wherein the positioning regions are identical in construction.

5. The infant playpen according to claim 1, wherein each of the slots is being configured to engage with a protrusion provided on a removable accessory.

6. The infant playpen according to claim 1, wherein the infant playpen has a central axis extending centrally between the first and second upper side rail assemblies, and the positioning regions include four positioning regions arranged in a distribution that is symmetrical with respect to the central axis.

7. The infant playpen according to claim 1, wherein the infant playpen has a transversal axis that intersects respective centers of the first and second upper side rail assemblies, and the positioning regions include four positioning regions arranged in a distribution that is symmetrical with respect to the transversal axis.

8. The infant playpen according to claim 1, further including an enclosure stretched between the upright legs, the enclosure being comprised of a cloth material that wraps at least partially around the elongated segments, the cloth material respectively covering the positioning regions on the elongated segments.

9. The infant playpen according to claim 1, further including an enclosure stretched between the upright legs, the enclosure being comprised of a cloth material that wraps at least partially around the elongated segments, the cloth material having openings for respectively exposing the positioning regions on the elongated segments.

10. The infant playpen according to claim 1, wherein each of the positioning regions is configured to engage with any of a changing station, a napper device, a bassinet, a canopy, a toy bar and a storage tray.

11. An infant care system comprising:

the infant playpen according to claim 1; and a removable accessory installable on the infant playpen in one or more configurations by selectively registering with one or more of the positioning regions.

12. The infant care system according to claim 11, wherein the positioning regions include four positioning regions, and the removable accessory when installed on the infant playpen attaches to the four positioning regions.

13. The infant care system according to claim 11, wherein the removable accessory includes:

a housing having a saddle portion and a coupling portion; and a locking part connected with the housing;

wherein when the removable accessory is installed on the infant playpen, one selected positioning region on the elongated segment of the first upper side rail assembly is received in the saddle portion, the coupling portion engages with the selected positioning region to prevent displacement of the housing along the elongated segment, and the locking part is displaced to a locked position that retains the selected positioning region in the saddle portion.

14. The infant care system according to claim 13, wherein the housing has a resilient portion, and a retaining rib formed on an inner sidewall of the resilient portion, the locking part when in the locked position being engaged with the retaining rib, and the resilient portion being deflectable to disengage the retaining rib from the locking part.

15. The infant care system according to claim 13, wherein the housing is assembled with a release button having an inner sidewall and a retaining rib formed on the inner sidewall, the locking part when in the locked position being engaged with the retaining rib, and the release button being operable to disengage the retaining rib from the locking part.

16. The infant care system according to claim 13, wherein the coupling portion includes a protrusion configured to engage with at least one of the slots of one selected positioning region.

17. The infant care system according to claim 16, wherein the protrusion vertically slides through the slot of one selected positioning region to register the removable accessory with the selected positioning region.

18. An infant care system comprising:

an infant playpen including:

a plurality of upright legs; and a first and a second upper side rail assembly supported by the upright legs, wherein each of the first and second upper side rail assemblies includes at least one elongated segment having an outer surface, and a plurality of positioning regions are defined on the outer surfaces of the elongated segments;

a removable accessory installed on the infant playpen, the removable accessory including:

a housing having a saddle portion and a coupling portion; and a locking part connected with the housing;

wherein one selected positioning region on the first upper side rail assembly is received in the saddle portion, the coupling portion engages with the selected positioning region to prevent displacement of the housing along the first upper side rail assembly, and the locking part is displaced to a locked position that retains the selected positioning region in the saddle portion.

19. The infant care system according to claim 18, wherein the first upper side rail assembly includes a first and a second segment pivotally connected with a first joint, the second upper side rail assembly includes a third segment and a fourth segment pivotally connected with a second joint, and the positioning regions are respectively defined on the first, second, third and fourth segments.

20. The infant care system according to claim 19, wherein the first, second, third and fourth segments are respectively formed to include the positioning regions.

21. The infant care system according to claim 18, wherein all of the positioning regions are identical in construction.

22. The infant care system according to claim 18, wherein the housing has a resilient portion, and a retaining rib formed on an inner sidewall of the resilient portion, the locking part when in the locked position being engaged with the retaining rib, and the resilient portion being deflectable to disengage the retaining rib from the locking part.

23. The infant care system according to claim 18, wherein the housing is assembled with a release button having an inner sidewall and a retaining rib formed on the inner sidewall, the locking part when in the locked position being engaged with the retaining rib, and the release button being operable to disengage the retaining rib from the locking part.

24. The infant care system according to claim 18, wherein the coupling portion includes a protrusion, and each of the positioning regions includes a slot configured to receive the protrusion.

25. The infant care system according to claim 24, wherein the protrusion vertically slides through the slot of the selected positioning region to engage the removable accessory with the selected positioning region.

26. The infant care system according to claim 18, wherein the infant playpen has a central axis extending between the first and second upper rail assemblies, and the positioning regions are arranged in a distribution that is symmetrical with respect to the central axis.

27. The infant care system according to claim 18, wherein the infant playpen has a transversal axis that intersects respective centers of the first and second upper side rail assemblies, and the positioning regions are arranged in a distribution that is symmetrical with respect to the transversal axis.

28. The infant care system according to claim 18, wherein the infant playpen further includes an enclosure stretched between the upright legs, the enclosure being comprised of a cloth material that wraps at least partially around the first and second upper rail assemblies, and covers the positioning regions thereon.

29. The infant care system according to claim 18, wherein the infant playpen further includes an enclosure stretched between the upright legs, the enclosure being comprised of a cloth material that that have openings for respectively exposing the positioning regions on the first and second upper rail assemblies.

30. The infant care system according to claim 18, wherein the removable accessory is selectively installable on the infant playpen in a first position in which the removable accessory respectively engages with two first ones of the four positioning regions respectively provided on the first and second upper side rail assemblies, and in a second position in which the removable accessory respectively engages with two second ones of the positioning regions respectively provided on the first and second upper side rail assemblies.

31. The infant care system according to claim 18, wherein the positioning regions include four positioning regions, and the removable accessory when installed on the infant playpen engages with the four positioning regions.

32. An infant playpen comprising:

a plurality of upright legs; and a first and a second upper side rail assembly supported by the upright legs, wherein each of the first and second upper side rail assemblies includes at least one elongated segment having an outer surface, and a plurality of positioning regions are defined on the outer surfaces of the elongated segments, each of the positioning regions being configured to locate a connection of a removable accessory on the infant playpen, and each of the positioning regions being defined from a distinctive geometrical shape formed by the corresponding segment.

33. The infant playpen according to claim 32, wherein the distinctive geometrical shape includes one or more slots, each of the slots being configured to respectively engage with a protrusion provided on a removable accessory.

34. The infant playpen according to claim 32, wherein the first upper side rail assembly includes a first and a second segment pivotally connected with a first joint, the second upper side rail assembly includes a third segment and a fourth segment pivotally connected with a second joint, and the positioning regions include four positioning regions respectively distributed on the first, second, third and fourth segments.

35. The infant playpen according to claim 32, wherein the positioning regions are identical in construction.

36. The infant playpen according to claim 32, wherein the infant playpen has a central axis extending centrally between the first and second upper side rail assemblies, and the positioning regions include four positioning regions arranged in a distribution that is symmetrical with respect to the central axis.

37. The infant playpen according to claim 32, wherein the infant playpen has a transversal axis that intersects respective centers of the first and second upper side rail assemblies, and the positioning regions include four positioning regions arranged in a distribution that is symmetrical with respect to the transversal axis.

38. The infant playpen according to claim 32, further including an enclosure stretched between the upright legs, the enclosure being comprised of a cloth material that wraps at least partially around the elongated segments, the cloth material respectively covering the positioning regions on the elongated segments.

39. The infant playpen according to claim 32, further including an enclosure stretched between the upright legs, the enclosure being comprised of a cloth material that wraps at least partially around the elongated segments, the cloth material having openings for respectively exposing the positioning regions on the elongated segments.

40. The infant playpen according to claim 32, wherein each of the positioning regions is configured to engage with any of a changing station, a napper device, a bassinet, a canopy, a toy bar and a storage tray.

41. An infant care system comprising:

the infant playpen according to claim 32; and a removable accessory installable on the infant playpen in one or more configurations by selectively registering with one or more of the positioning regions.

42. The infant care system according to claim 41, wherein the removable accessory includes:

a housing having a saddle portion and a coupling portion; and a locking part connected with the housing;

wherein when the removable accessory is installed on the infant playpen, one selected positioning region on the elongated segment of the first upper side rail assembly is received in the saddle portion, the coupling portion engages with the selected positioning region to prevent displacement of the housing along the elongated segment, and the locking part is displaced to a locked position that retains the selected positioning region in the saddle portion.

43. The infant care system according to claim 42, wherein the housing is assembled with a release button having an inner sidewall and a retaining rib formed on the inner sidewall, the locking part when in the locked position being engaged with the retaining rib, and the release button being operable to disengage the retaining rib from the locking part.

44. The infant care system according to claim 42, wherein the coupling portion includes a protrusion, and each of the positioning regions includes a slot configured to receive the protrusion.

45. The infant care system according to claim 44, wherein the protrusion vertically slides through the slot of the selected positioning region to engage the removable accessory with the selected positioning region.

* * * * *